US009517976B2

(12) United States Patent
Mackal

(10) Patent No.: US 9,517,976 B2
(45) Date of Patent: Dec. 13, 2016

(54) INFLATOR

(71) Applicant: Glenn H. Mackal, South Pasadena, FL (US)

(72) Inventor: Glenn H. Mackal, South Pasadena, FL (US)

(73) Assignee: Halkey-Roberts Corporation, St. Petersburg, FL (US)

( * ) Notice: Subject to any disclaimer, the term of this patent is extended or adjusted under 35 U.S.C. 154(b) by 0 days.

(21) Appl. No.: 13/896,180

(22) Filed: May 16, 2013

(65) Prior Publication Data

US 2015/0166422 A1 Jun. 18, 2015

Related U.S. Application Data

(60) Provisional application No. 61/648,072, filed on May 16, 2012.

(51) Int. Cl.
*B63C 9/18* (2006.01)
*C06D 5/00* (2006.01)
*B63C 9/19* (2006.01)

(52) U.S. Cl.
CPC .. *C06D 5/00* (2013.01); *B63C 9/19* (2013.01)

(58) Field of Classification Search
USPC ..... 102/367, 530; 222/3, 5; 244/905, 137.2; 441/41, 92, 93, 94, 96
See application file for complete search history.

(56) References Cited

U.S. PATENT DOCUMENTS 3,757,371 A * 9/1973 Martin ..... 441/94
3,915,236 A * 10/1975 Stichling ..... 169/61
4,024,440 A * 5/1977 Miller ..... 361/251
4,157,167 A 6/1979 Akkerman
4,768,128 A * 8/1988 Jankowiak et al. ..... 361/251
5,026,310 A * 6/1991 Mackal et al. ..... 441/93
5,158,122 A 10/1992 Moffett
5,311,394 A * 5/1994 Naab et al. ..... 361/248
5,370,567 A 12/1994 Glasa
5,400,922 A * 3/1995 Weinheimer et al. ..... 222/5
5,419,725 A * 5/1995 Crowder et al. ..... 441/10
5,509,576 A 4/1996 Weinheimer
5,518,430 A * 5/1996 Crowder et al. ..... 441/93
6,089,403 A 7/2000 Mackal
6,131,949 A 10/2000 Lewis et al.
7,011,232 B2 * 3/2006 Colombo ..... 222/5
7,178,547 B2 2/2007 Makal
7,572,161 B2 * 8/2009 Mackal et al. ..... 441/95
7,669,616 B2 * 3/2010 Bruengger ..... 141/19
(Continued)

FOREIGN PATENT DOCUMENTS

WO 96/37402 A1 11/1996

*Primary Examiner* — Benjamin P Lee

(74) *Attorney, Agent, or Firm* — GrayRobinson, P.A.

(57) ABSTRACT

An inflator for inflating an inflatable device to which it is connected via fill tubes or in which it is positioned. The inflator comprises a power module assembly and an adaptor assembly intended to be threaded into or onto the threaded neck of a gas cylinder (not shown). The power module assembly employs one or more power primers that are fired when a tether is pulled to remove the actuator cup to release a spring-loaded actuator pin to fire the power primer(s). The escaping gases from the power primer(s) then drive a pierce pin to fracture a frangible seal allowing gas in the gas cylinder to then flow into the inflatable device and inflate the same.

8 Claims, 33 Drawing Sheets

(56) References Cited

U.S. PATENT DOCUMENTS

| | | | | |
|---|---|---|---|---|
| 8,826,931 | B2 * | 9/2014 | Clark et al. | 137/81.2 |
| 2004/0094569 | A1 * | 5/2004 | Colombo | 222/5 |
| 2004/0124209 | A1 | 7/2004 | Mackal | |
| 2008/0038970 | A1 * | 2/2008 | Isberg et al. | 441/93 |
| 2012/0217263 | A1 * | 8/2012 | Becnel | 222/5 |

* cited by examiner

INFLATOR

CROSS-REFERENCE TO RELATED APPLICATIONS

This application claims the benefit of provisional application No. 61/648,072, filed May 16, 2012, the disclosure of which is incorporated by reference herein.

BACKGROUND OF THE INVENTION

Field of the Invention

This invention relates to inflators. More particularly, this invention relates to inflation valves for compressed gas cylinders used for inflating inflatable articles such as life rafts.

Description of the Background Art

Presently there exist many types of inflation valves designed to be used in conjunction with compressed gas cylinders or the like. In their simplest forms, inflation valves include a knob or handle which is turned to open a cylinder of compressed gas to inflate the inflatable article. However, even more prevalent are inflation valves for sealed gas cylinders having a sealed, frangible seal. Inflation valves of this type are operable by means of a jerk handle and lanyard cord that allow the inflatable article to be quickly inflated by a simple jerking of the handle which then forces a pierce pin to fracture the frangible seal of the gas cylinder, thereby allowing the compressed gas therein to flow out of the gas cylinder to inflate the inflatable article.

Due to the large force necessary to fracture the frangible seal of a conventional gas cylinder, particularly for raft inflators that require inflation from a large gas cartridge, more contemporary designs of inflation valves employ a powerful firing spring which is held in its cocked position by means of a sear. Upon jerking of the jerk handle by the user, the sear is released allowing the powerful spring to very forcibly force the pierce pin through the frangible seal of the gas cylinder.

To eliminate the need for inflators having powerful firing springs held in cocked positions, still more contemporary inflation valves utilize the internal pressure of the gas cylinder to assist in driving the pierce pin fully through the frangible seal. A representative inflation system with such a pneumatic assist feature, is disclosed in my U.S. Pat. Nos. 6,089,403 and 7,178,547, the disclosures of which are hereby incorporated by reference herein.

Jerk handle inflators and pneumatic assisted inflators are in widespread use in the inflator industry. However, there presently exists a need for inflators that more easily allow actuation by an inflation lanyard.

Therefore, an object of this invention to provide an improvement which overcomes the aforementioned inadequacies of the prior art devices and provides an improvement which is a significant contribution to the advancement of the inflator art.

Another object of this invention is to provide an inflator that is capable of use with large compressed gas cartridges.

Another object of this invention is to provide an inflator that employs a power primer which, upon firing, drives a firing pin through a frangible seal to allow gas from a gas cartridge to escape therefrom an inflate an inflatable article.

The foregoing has outlined some of the pertinent objects of the invention. These objects should be construed to be merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

SUMMARY OF THE INVENTION

For the purpose of summarizing this invention, this invention comprises an inflator having a power module assembly and an adaptor assembly intended to be threaded into or onto the threaded neck of a gas cylinder (not shown). The power module assembly is actuated by a tether connected to an actuator cup that maintains a spring-loaded actuator pin in its ready, cocked position. The adaptor assembly comprises one or more ports allowing connection of conventional fill tubes fluidly connected to the inflatable device to be inflated or an exhaust port that inflates the inflatable device in which the inflator is installed.

The power module employs one or more power primers that are fired when the tether is pulled to remove the actuator cup. The escaping gases from the power primer(s) then drive a pierce pin to fracture a frangible seal allowing gas in the gas cylinder to then flow into the inflatable device and inflate the same.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

DETAILED DESCRIPTION OF THE PREFERRED EMBODIMENTS

Figure 10:
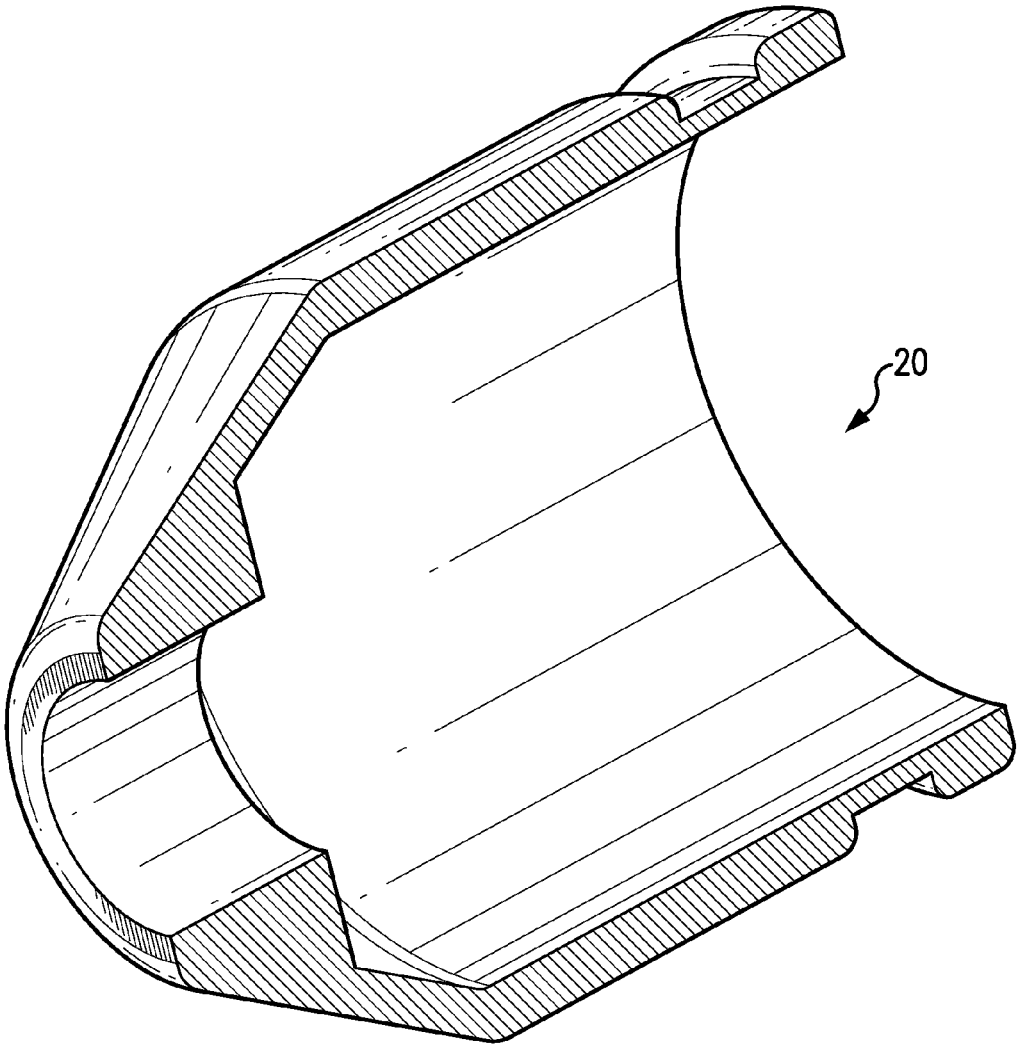
FIG. 10 is an enlarged sectional perspective view of the syphon weight.
Figure 11:
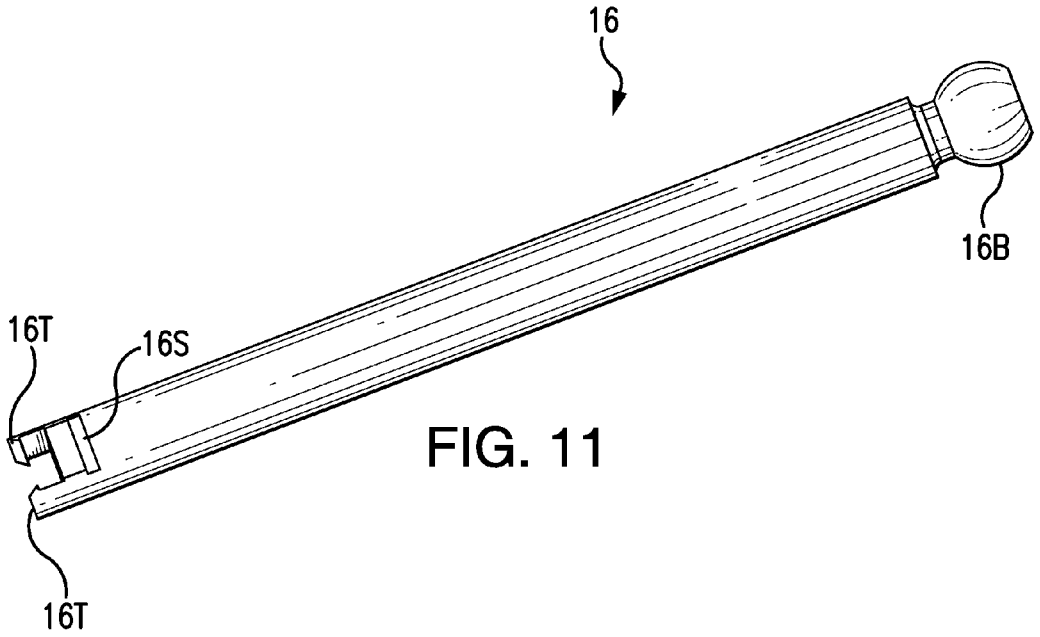
FIG. 11 is a perspective view of the syphon tube showing one end having a ball.
Figure 12:
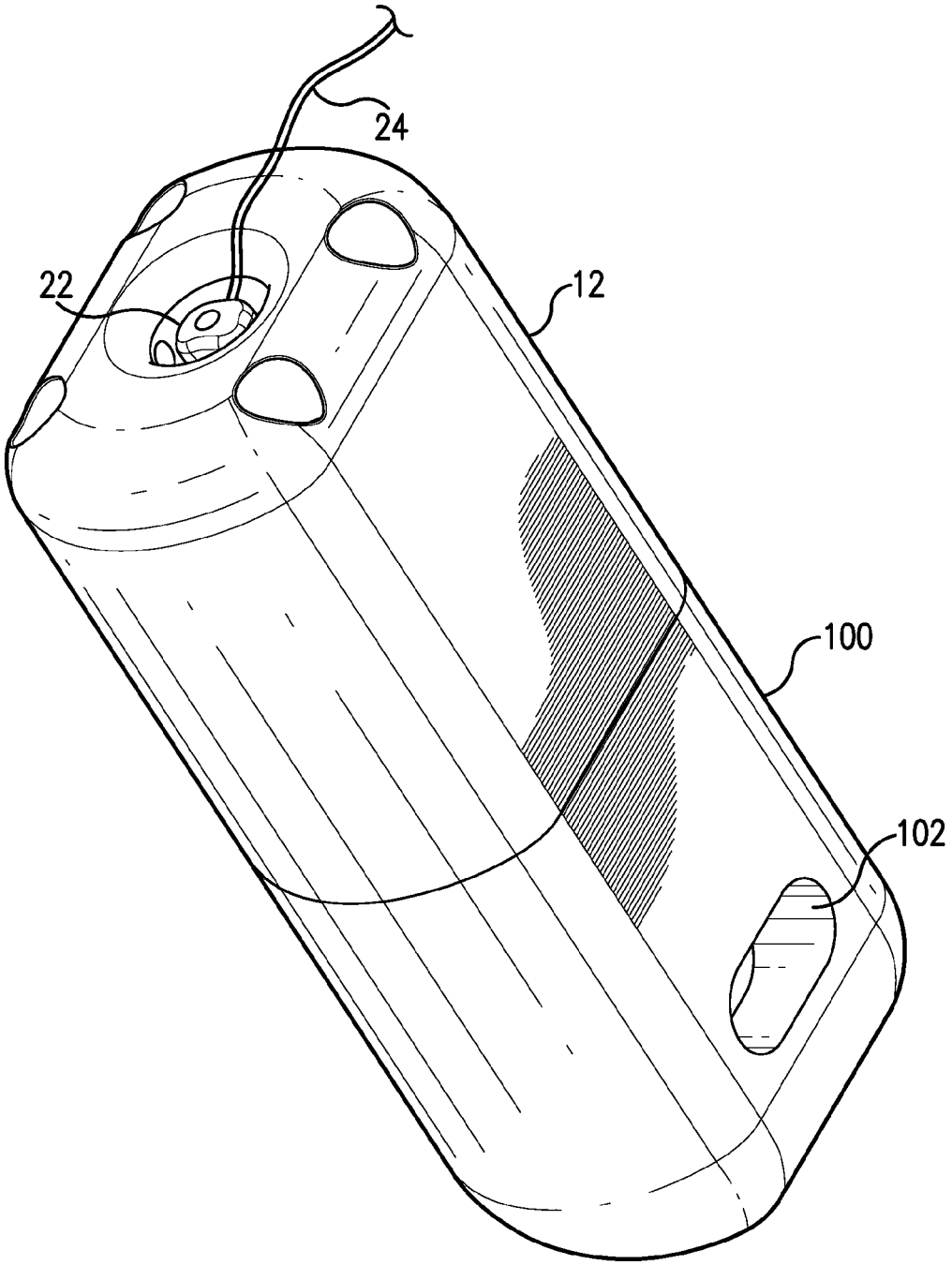
FIG. 12 is a perspective view of a second embodiment of the inflator.
Figure 13A:
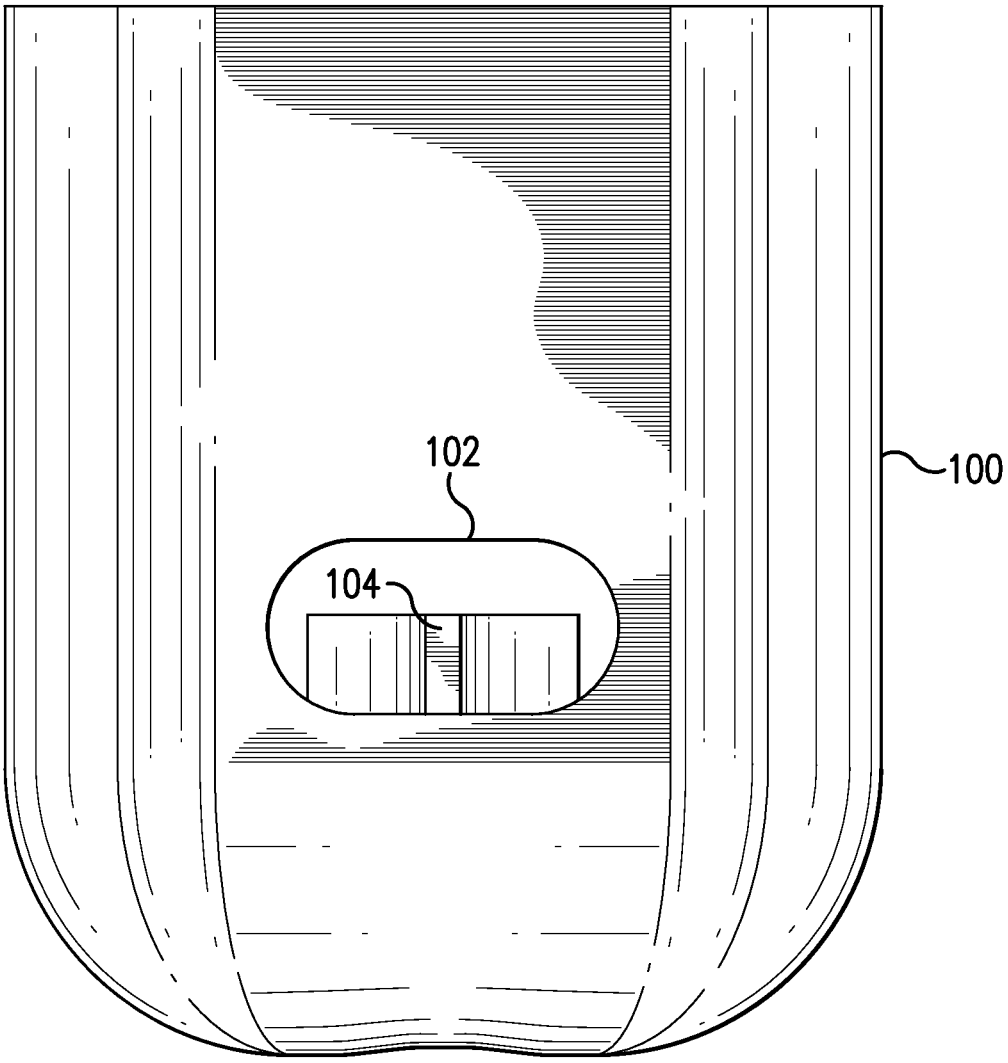
FIG. 13A is a front elevational view of the adaptor assembly of the second embodiment of the inflator.
Figure 13B:
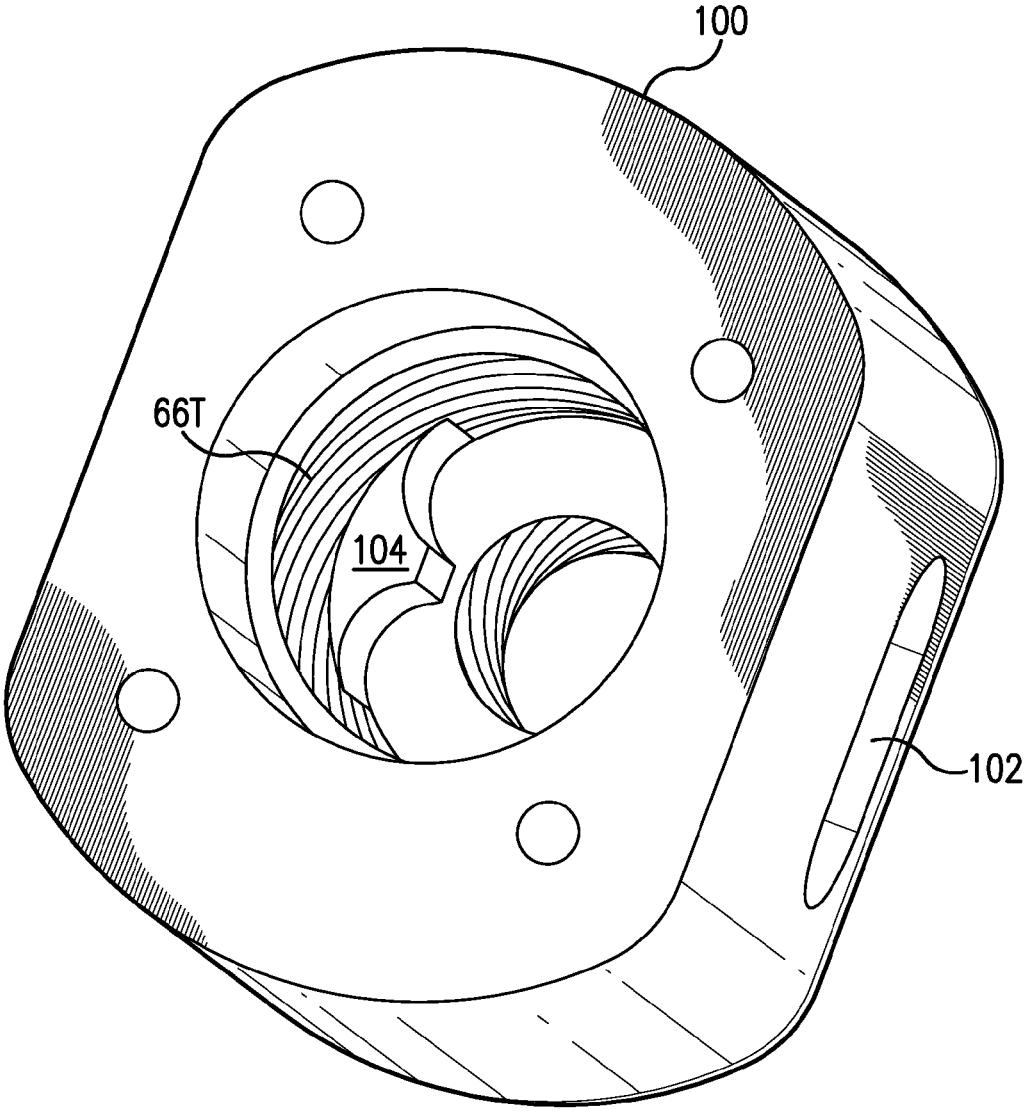
FIG. 13B is a top perspective view of FIG. 13A.
Figure 13C:
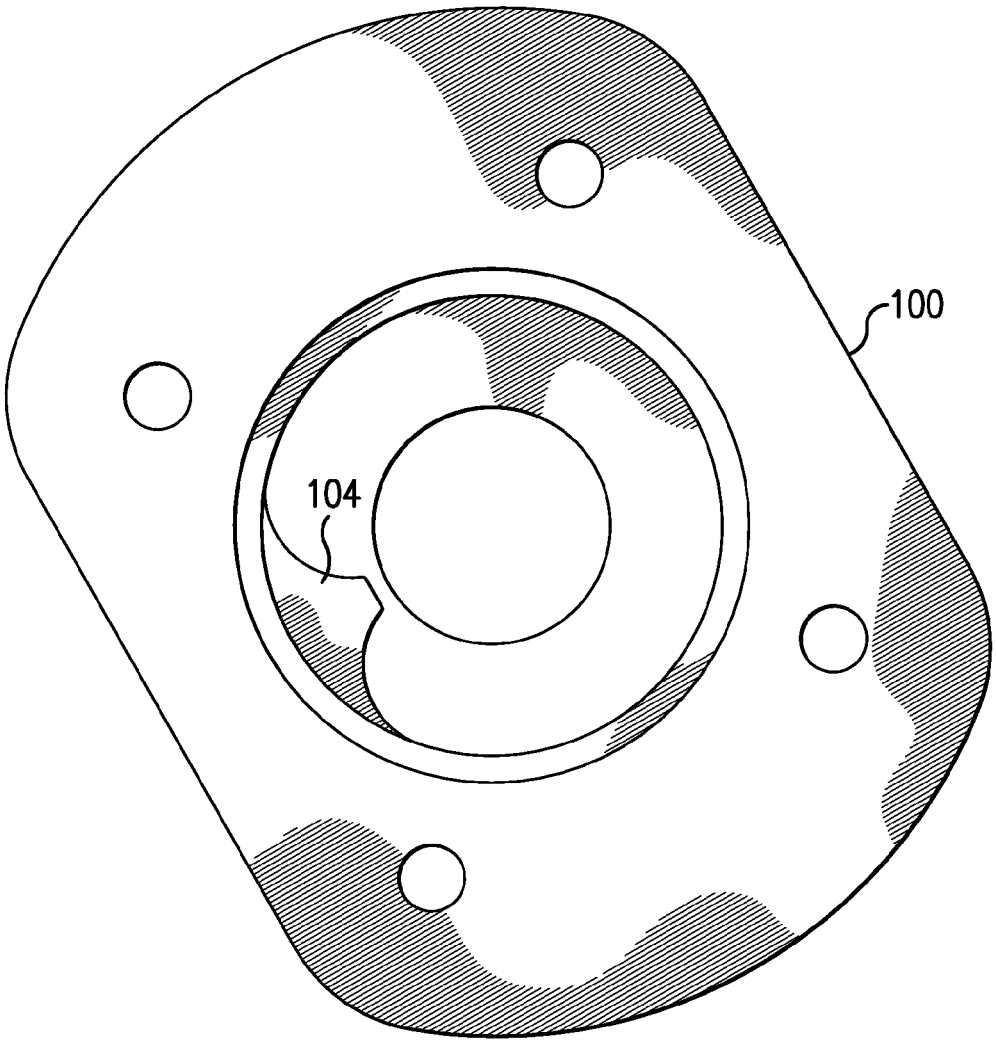
FIG. 13C is a top elevational view of FIG. 13A Similar reference characters refer to similar parts throughout the several views of the drawings.

The present invention is described in two embodiments; the first embodiment is shown in FIGS. 1-11 and the second embodiment is shown in FIGS. 12-13C. Both embodiments share many of the same components and therefore where appropriate common terminology and reference numerals are employed when describing the two embodiments. The first embodiment is particularly suited to be used as a raft inflator for inflatable slides and rafts commonly used in emergency situations such as escaping from a downed aircraft. The second embodiment is more generally suited as a general inflator for inflatable devices of many types such as inflatable vests (used for buoyancy in water or used as a personal "air bag" vest upon being ejected from a moving vehicle such as a motorcycle), inflatable structures such as portable "Mash" facilities and inflated-upon-deployment devices such as inflatable sonobuoys.

First Embodiment

Figure 1:
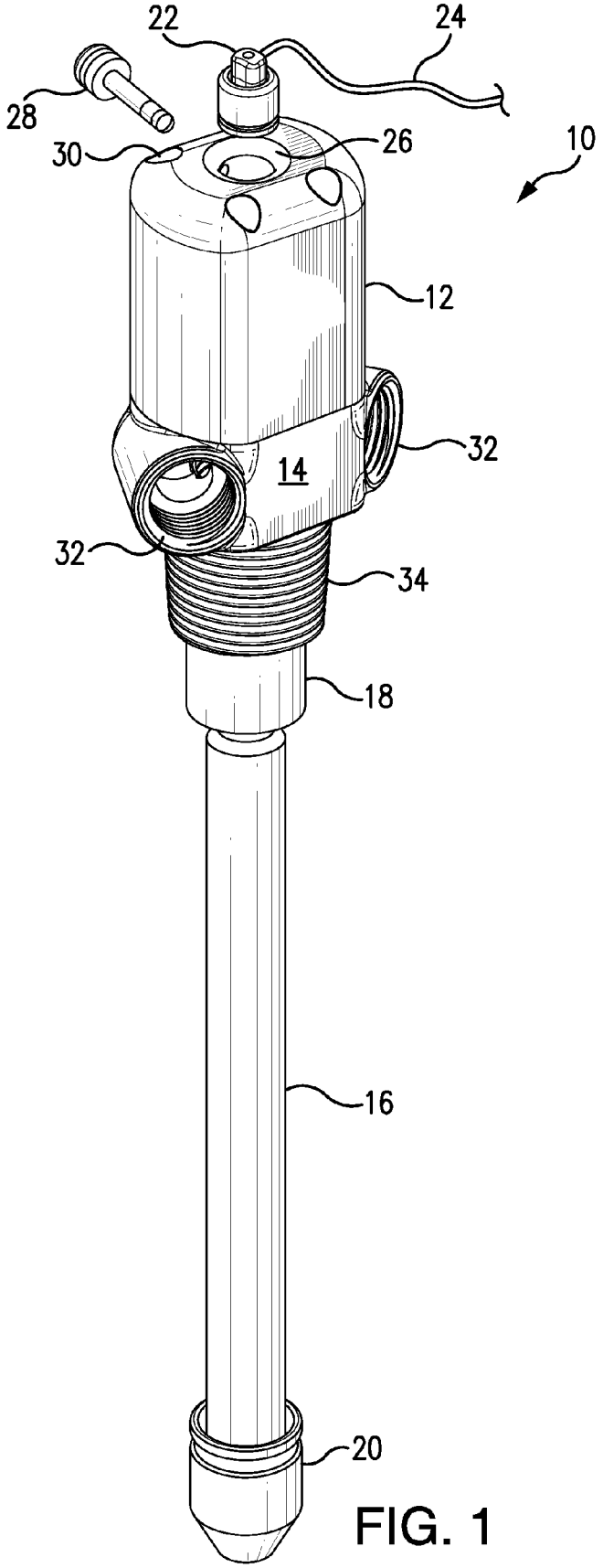
FIG. 1 is a top perspective view of the first embodiment of the raft inflator.

As shown in FIG. 1, the first embodiment of the inflator is a raft inflator 10 comprising a power module assembly 12 connected to a two port adaptor assembly 14 intended to be threaded into the threaded neck of a gas cylinder (not shown).

A syphon tube 16 is pivotably and fluidly connected to the output of the adaptor assembly 14 by means of a syphon coupler 18 allowing the tube 16, when the gas cylinder is oriented horizontally, to pivot downwardly toward the inside of the gas cylinder to draw liquid gas therefrom. A syphon weight 20 is preferably affixed to the end of the tube 16 to keep the end of the tube 16 in the most downward position, thereby assuring that all of the liquid is first drawn from the gas cylinder, then any remaining gas.

An actuator cup 22 having a tether 24 fits into an actuator bore 26 to maintain the power module assembly 12 in its ready position. A safety pin 28 extends into a pin hole 30 transversely through the power module assembly 12 to block removal of the actuator cup 24, thereby preventing inadvertent actuation during shipping and set-up. However, after the raft inflator 10 is set-up in its intended location of use, safety pin 28 must be removed to allow the actuator cup 24 to be removed from the power module 14 upon pulling of its tether 24.

The adaptor assembly 14 includes two threaded ports 32 allowing connection of conventional fill tubes (not shown) fluidly connected to the inflatable device to be inflated, such as an inflatable raft (not shown). The ports 32 are oriented in different directions to minimize undesirable torque being imparted to the raft inflator 10 during inflation. The adaptor assembly 14 includes a threaded male neck 34 to be threadedly connected into the threaded female neck of the gas cylinder.

Figure 2A:
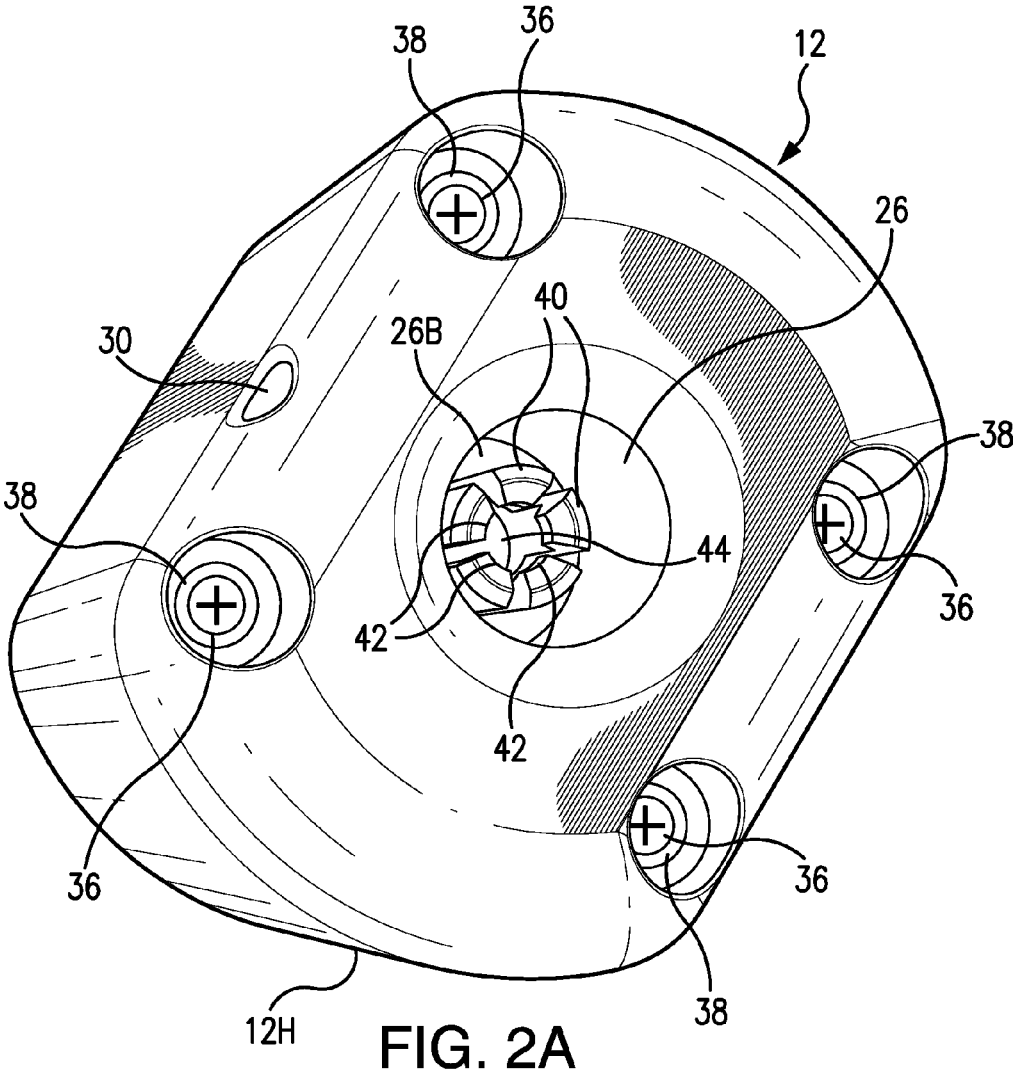
FIG. 2A is a top perspective view of the power module with the cup removed for clarity.
Figure 2B:
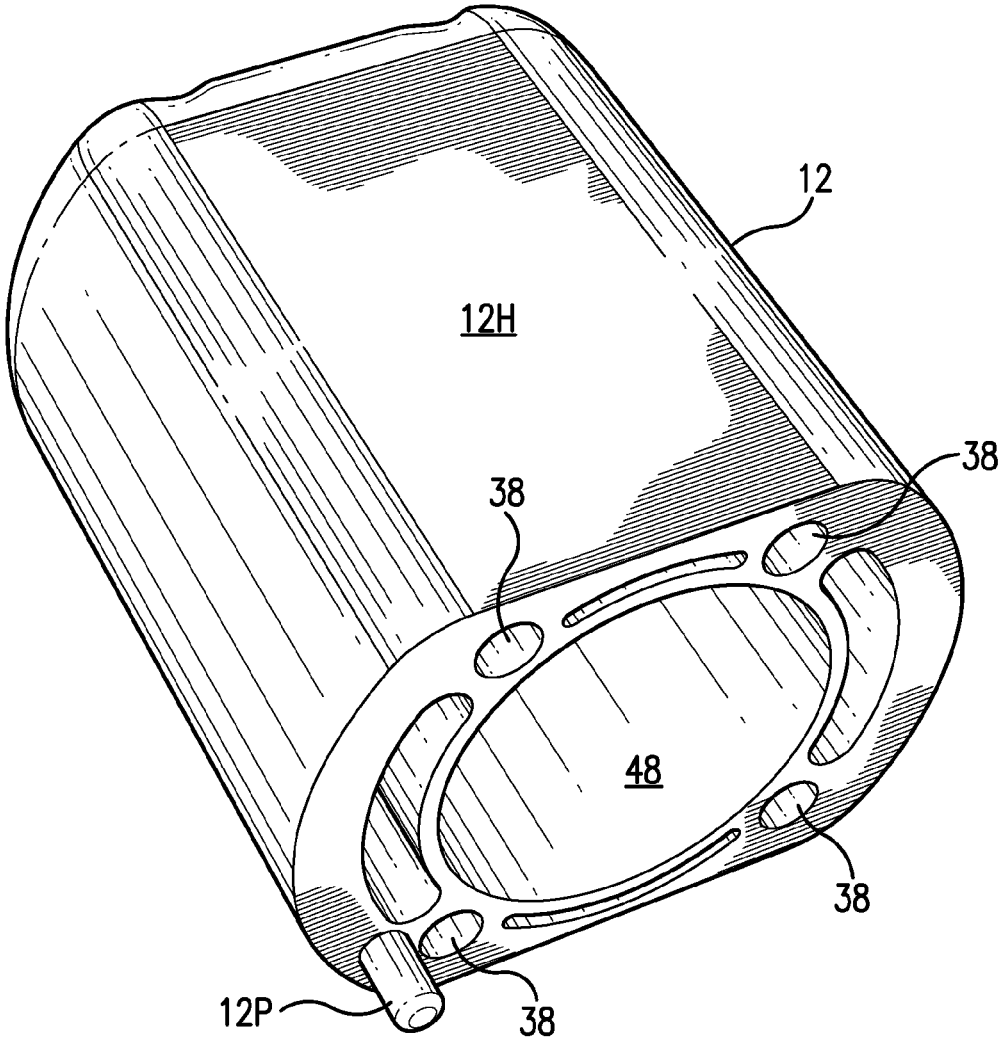
FIG. 2B is a bottom perspective view of the power module.
Figure 2C:
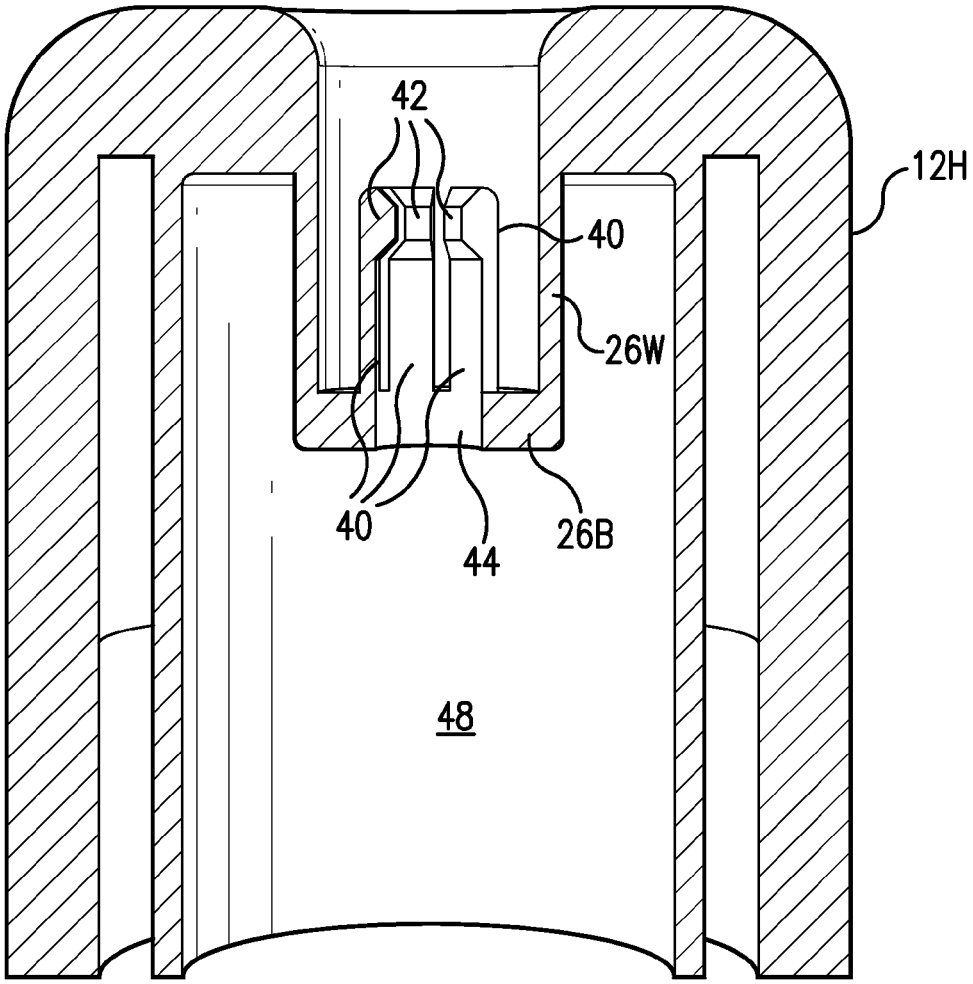
FIG. 2C is a cross-sectional view of the power module.
Figure 5A:
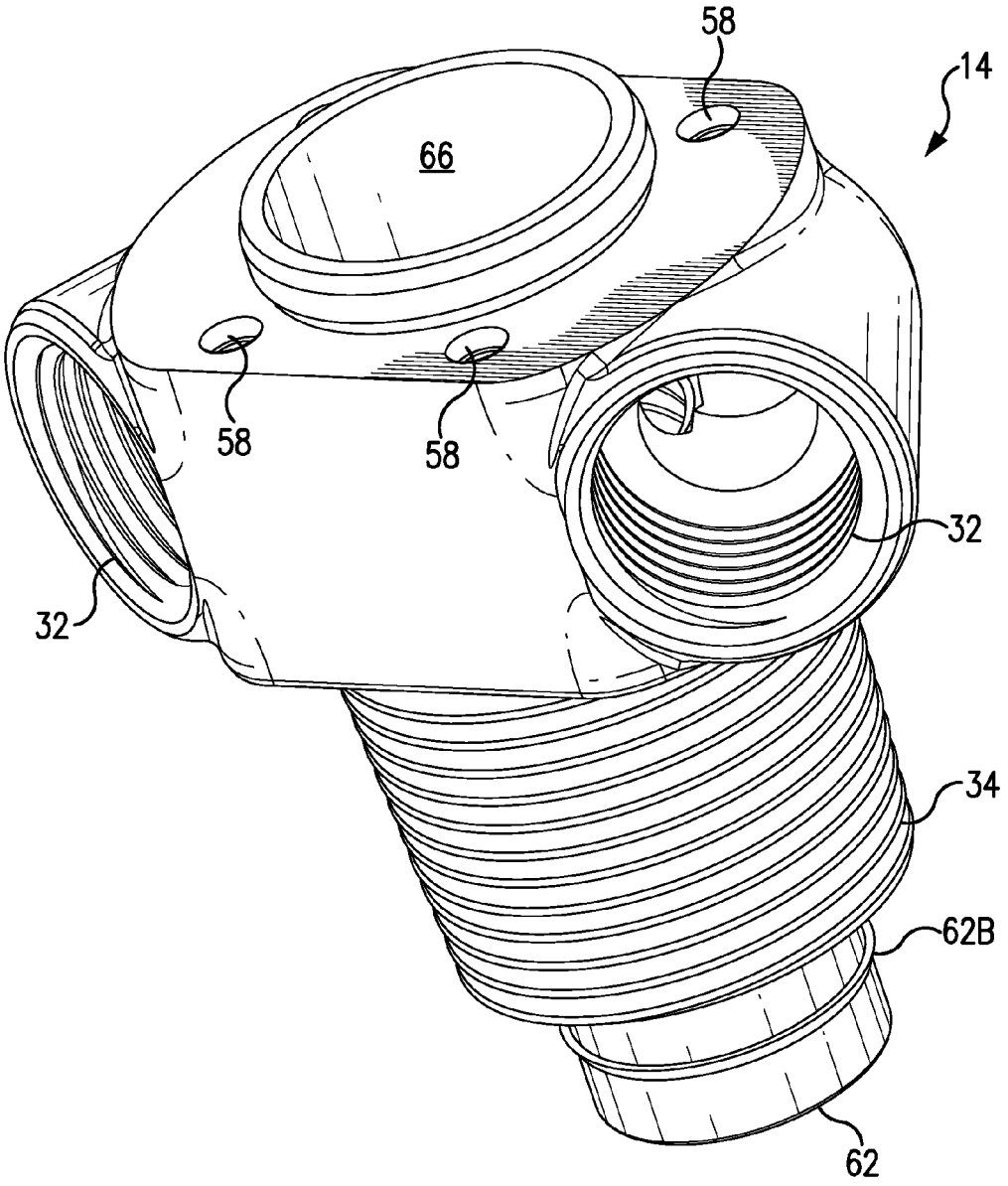
FIG. 5A is a top perspective view of the adaptor assembly.
Figure 5B:
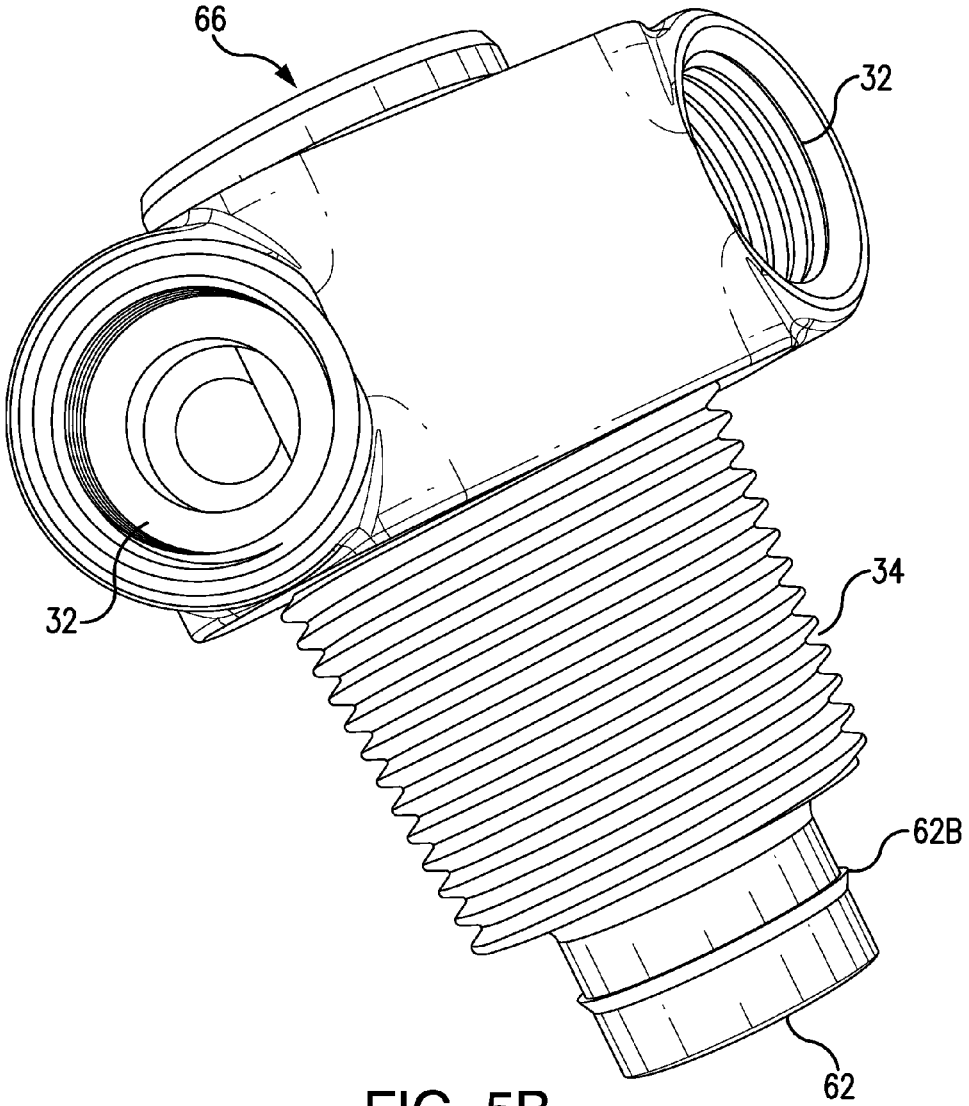
FIG. 5B is a side elevational view of FIG. 5A.
Figure 5C:
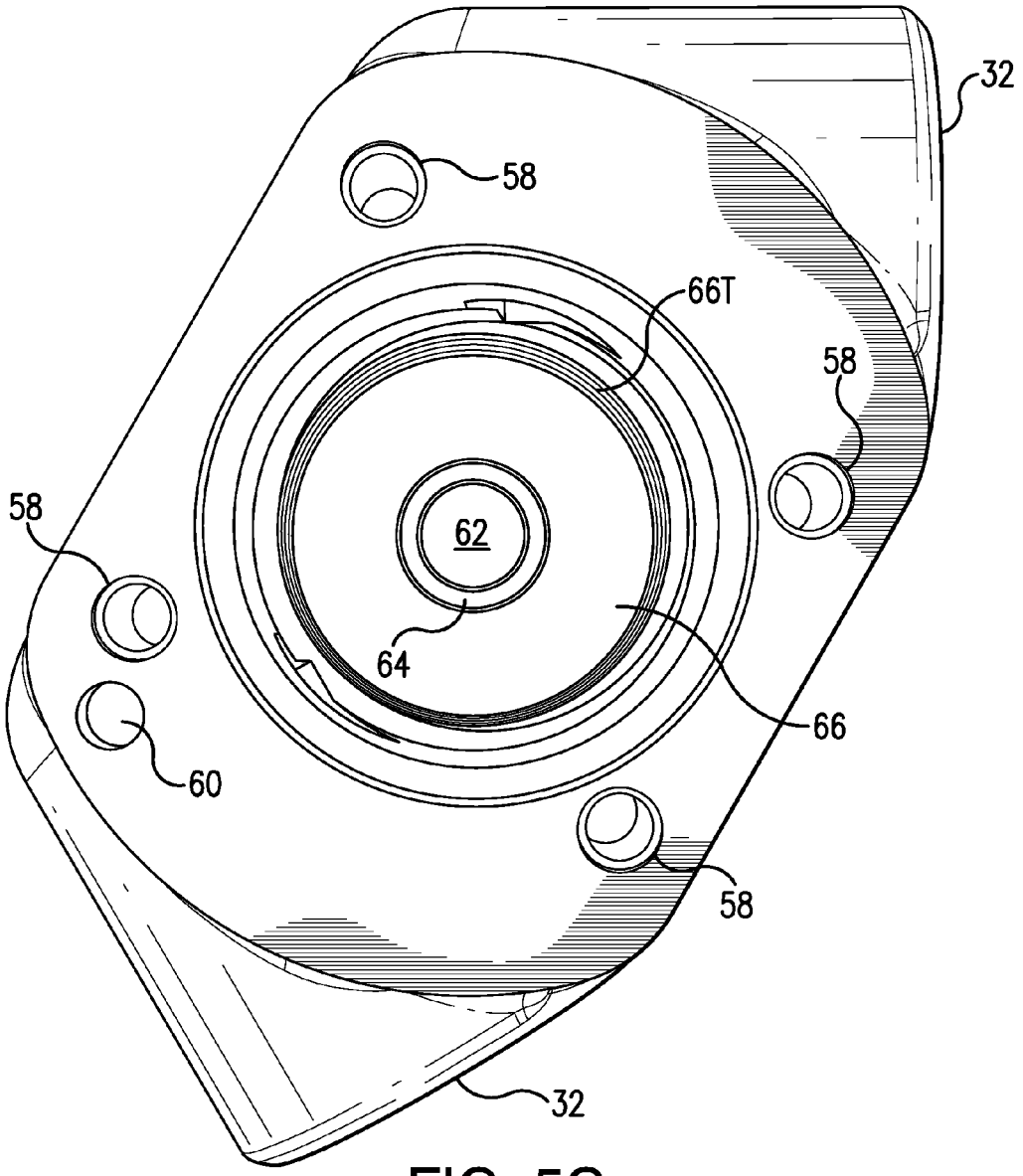
FIG. 5C is a top elevational view of FIG. 5A.
Figure 5D:
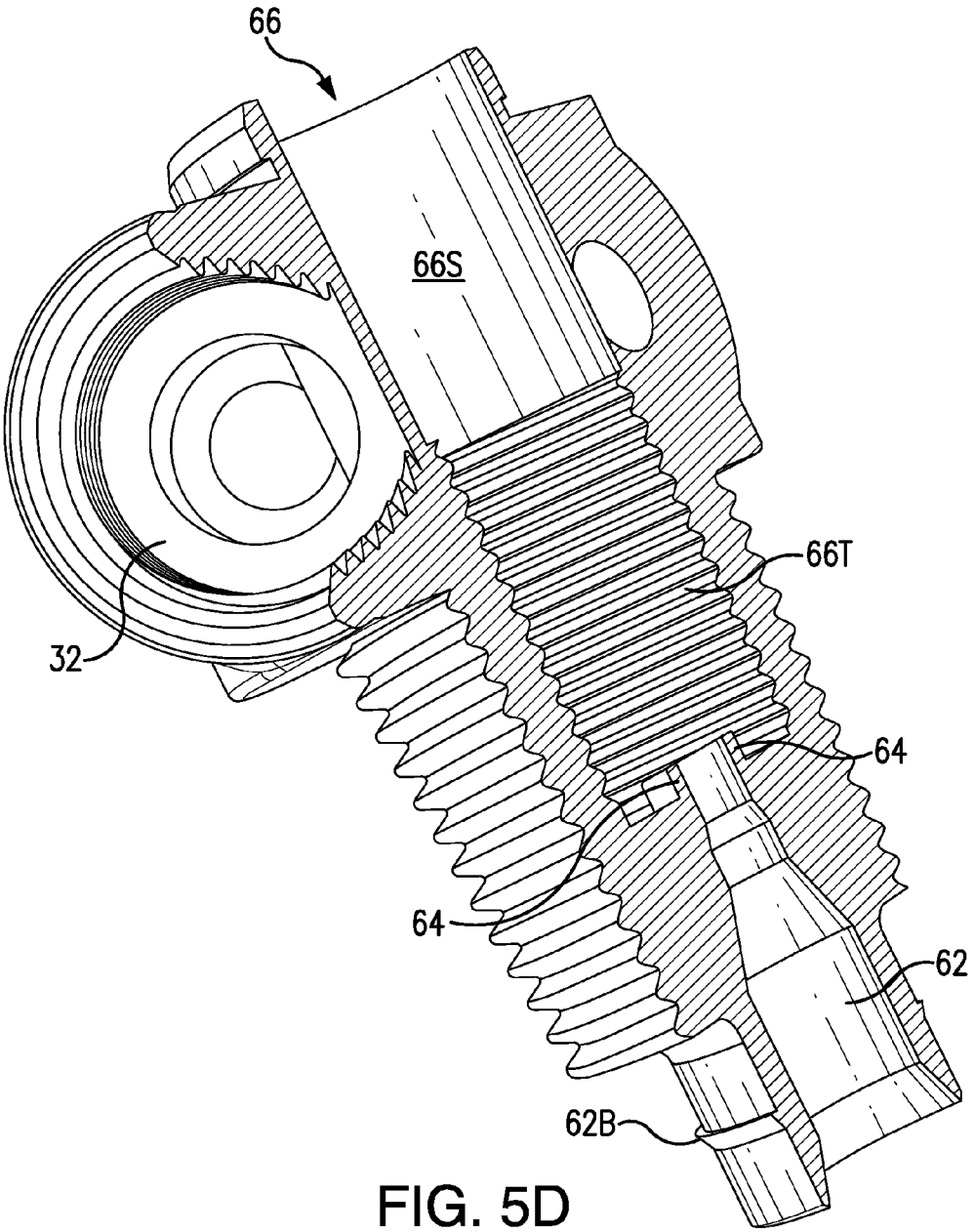
FIG. 5D is a cross-sectional view of FIG. 5A.

FIGS. 2A, 2B and 2C are top and bottom perspective views and a cross-sectional view of the housing 12H of the power module assembly 12 that is removably connected during assembly to the housing 14H of the adaptor assembly 14 by means of four bolts 36 that extend through bolt holes 38 positioned at the four corners of the housing 12H to threadably correspondingly engage into threaded holes 58 formed in the adaptor assembly housing 14H (see FIG. 5C). A locator pin 12P is provided to assure proper orientation during assembly.

The actuator bore 26 of the power module housing 12H is blind, defined by cylindrical side wall 26W and bottom 26B extending into the module housing 12H a distance sufficient to make room for a plurality of fingers 40 to extend upwardly from the bottom 26B of the bore 26. Each finger 40 comprises an inwardly-extending fingertip 42. The fingers 40 are positioned circumferentially around an actuator hole 44 formed through the center of the bottom 26B of the bore 26. The interior of the power module housing 12H includes a power module plug hole 48 into which is installed a power module plug 46 described hereinafter.

Figure 3A:
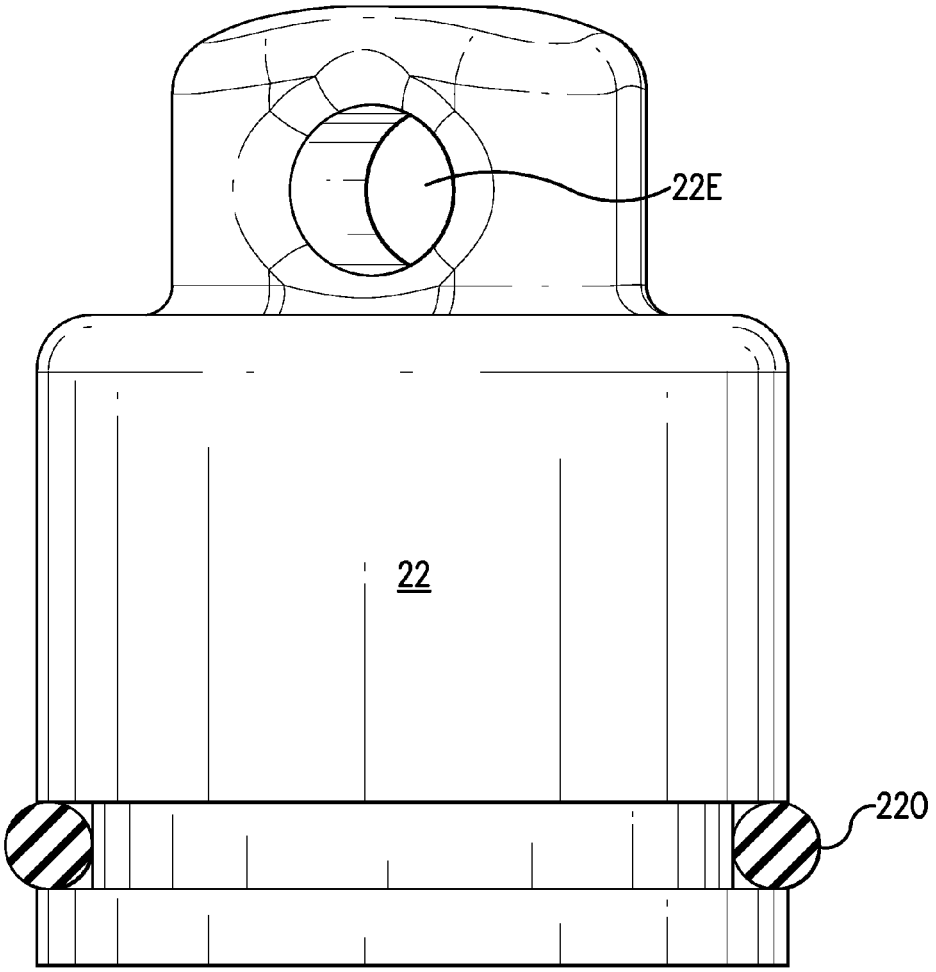
FIG. 3A is a front elevational view of the cup.
Figure 3B:
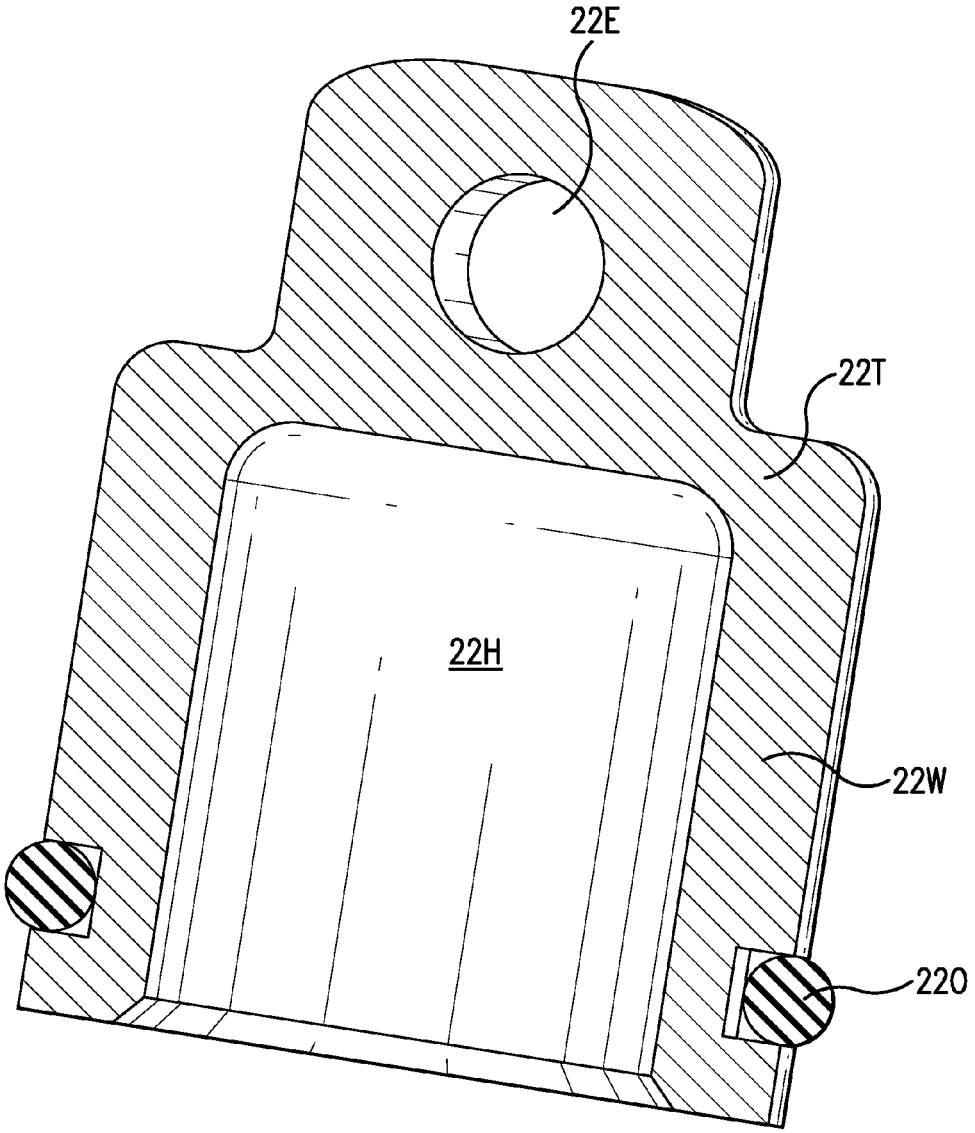
FIG. 3B is a cross-sectional view of FIG. 3.

The actuator cup 22 shown in FIGS. 3A and 3B comprises a generally cylindrical sidewall 22W and top wall 22T defining a blind hole 22H. The thickness and diameter of the sidewall 22W is dimensioned to fit into the cup bore 26 and take up the space between the fingers 40 and the inside surface of the sidewall of the cup bore 26 to keep the fingers 40 from spreading apart from their at rest position shown in FIG. 2. An O-ring 22O provides a seal preventing any contamination or water from entering the power module assembly 12. The top wall 22T includes a eyelet 22E allowing connection of the tether 24.

Figure 4A:
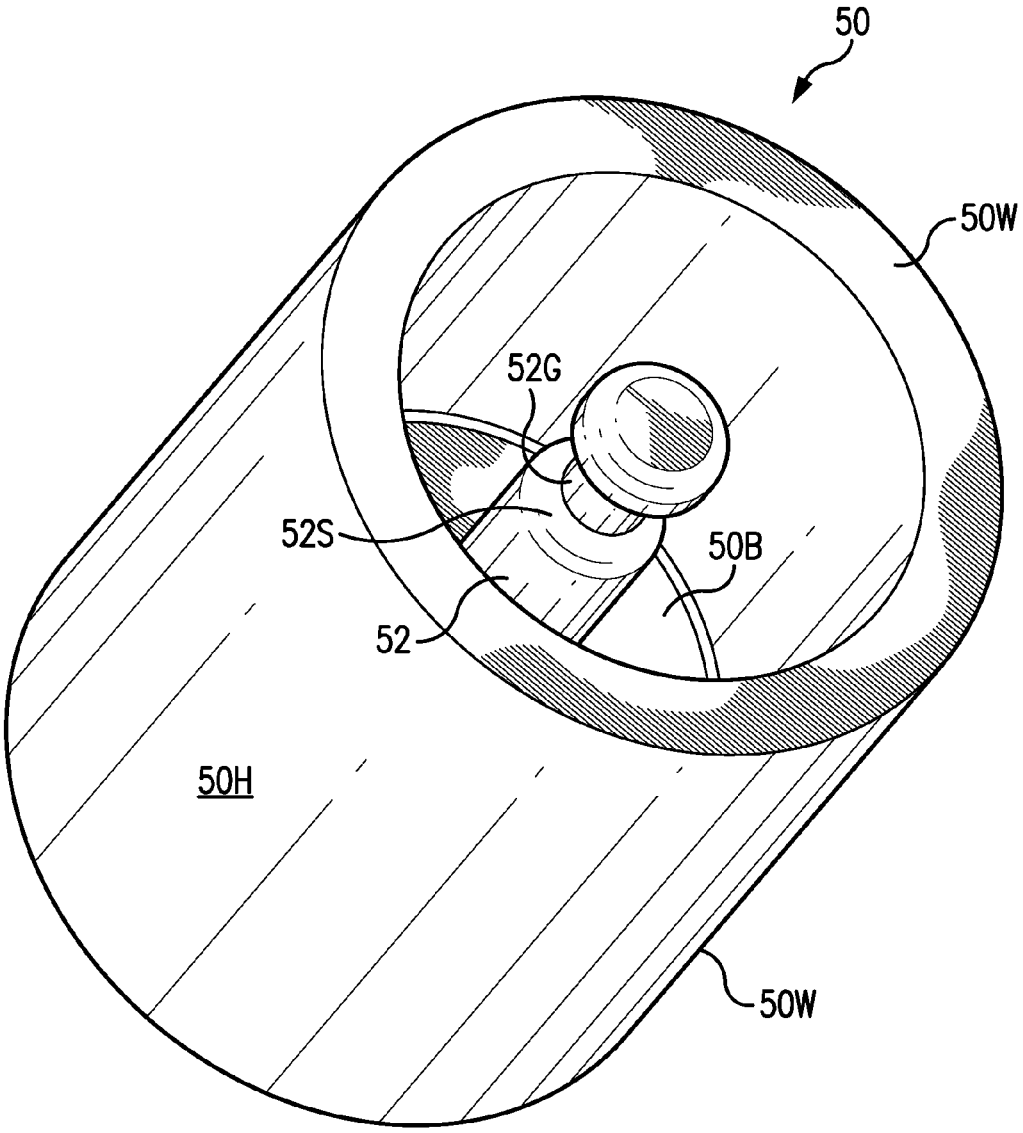
FIG. 4A is a top perspective view of the ballistic module with the first embodiment of the firing pin installed.
Figure 4B:
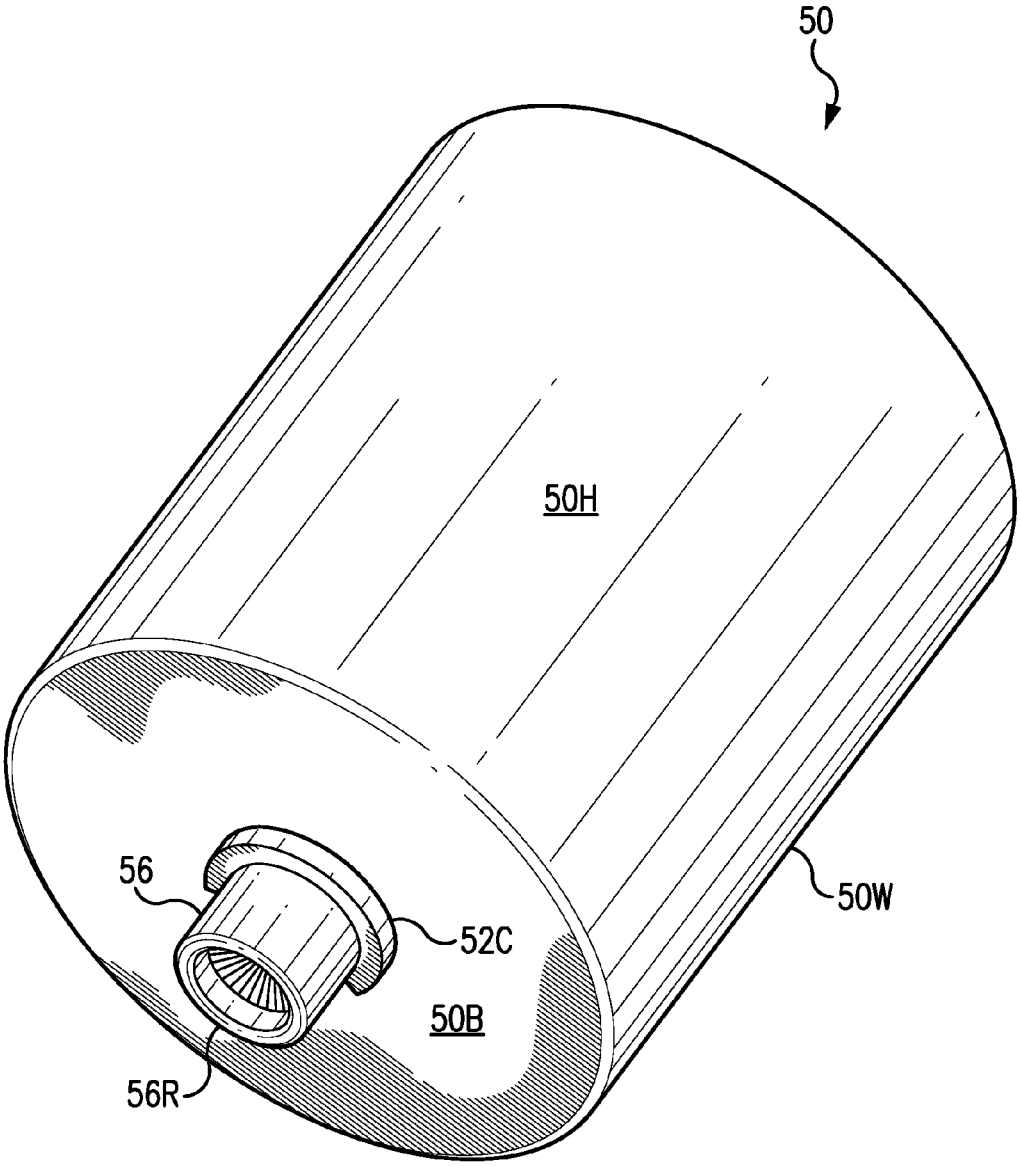
FIG. 4B is a bottom perspective view of FIG. 4A.
Figure 4C:
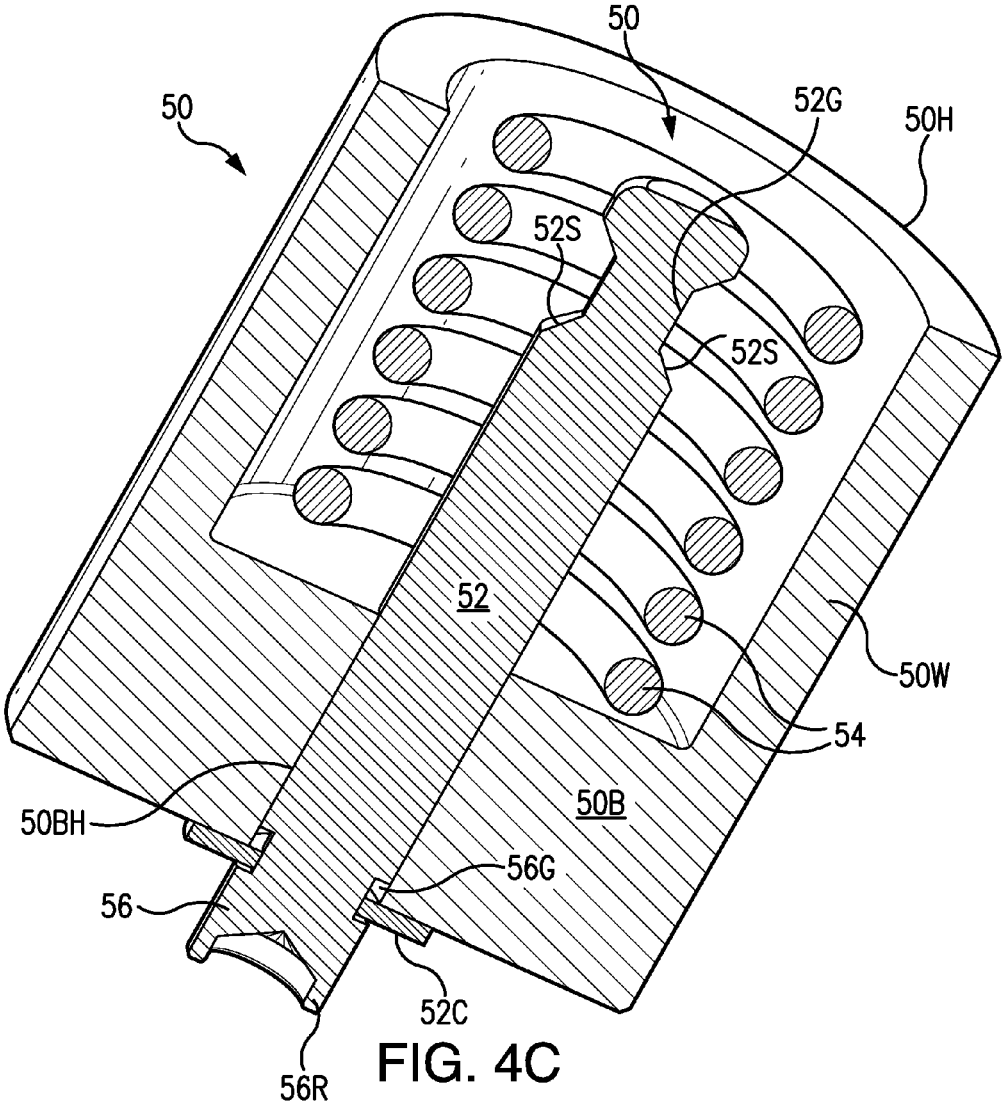
FIG. 4C is a cross-sectional view of FIG. 4A.

The power module assembly 12 comprises a ballistic module 50 shown in FIGS. 4A, 4B and 4C. The housing 50H of the module 50 comprises a blind spring bore 50 defined by cylindrical sidewall 50W and bottom wall 50B. An actuator pin 52 reciprocatably extends upwardly through a hole 50BH in the bottom wall 50B and is retained by a retainer clip 52C that clips into an annular groove 56G formed in the lower portion of the actuator pin 52. An actuator spring 54 is positioned in the spring bore 50B.

Figure 4D:
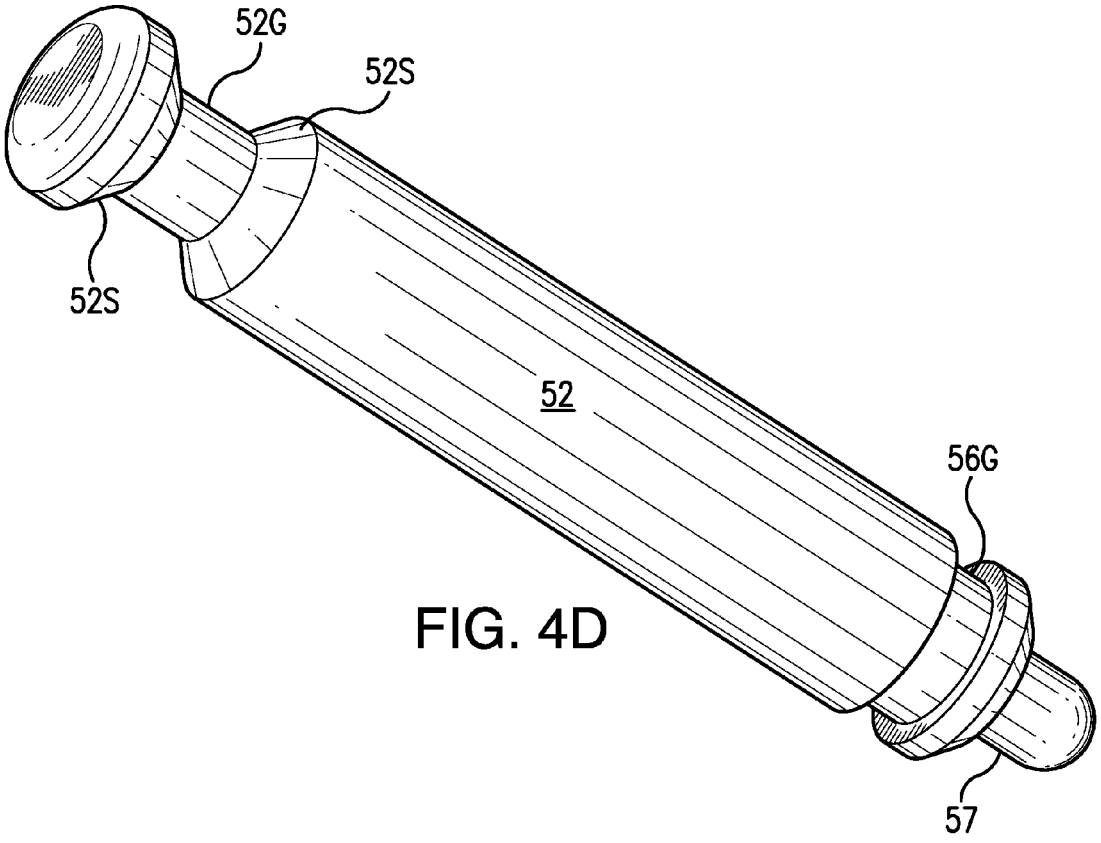
FIG. 4D is a perspective view of the second embodiment of the firing pin.

The upper tip of the actuator pin 52 comprises a reduced-diameter annular groove 52G configured and dimensioned to allow the fingertips 42 of the fingers 40 to fit therein and capture the actuator pin 52 when the ballistic module 50 is inserted into the power module bore 48, thereby compressing the spring 54. The sides 52S of the groove 52G are tapered to constantly urge the fingertips 42 outwardly to spread apart by the force of the compressed spring 54. The lower end of the actuator pin 52 comprises a firing pin 56 having an annular rim 56R designed to fire two power primers 86 (described below). FIG. 4D illustrates a modified actuator pin 52 having a bull-nose firing pin 57 designed to fire one power primer 86 (also described below).

The actuator pin 52 remains captured by the fingertips 42 so long as the actuator cup 22 remains in position in the actuator bore 26 since the actuator cup 22 prevents the fingers 40 from radially spreading apart. Once the actuator cup 22 is removed by pulling on the tether 24, the fingers 40 spread apart by the force of the compressed spring 54 acting on the tapered sides 52S of the groove 52G, thereby releasing the actuator pin 52. Upon release of the actuator pin 52, the compression spring 54 forcibly moves the ballistic module housing 52H and actuator pin 52 downwardly toward the adaptor assembly 14. The momentum of the ballistic module housing 52H and actuator pin 52 assures the firing pin 56 provides significant striking force to fire the power primer(s) 86.

The adaptor assembly 14 is shown in FIGS. 5A-D. As shown in FIG. 5A, its upper surface includes threaded bolt holes 58 for receiving the bolts 36 interconnecting the power module assembly 12 thereto and a locator hole 60 for receiving the locator pin 12P. The inlet 62 comprises an elongated bore circumscribed by an annular diaphragm seat 64. The end of the inlet 62 includes an annular barb 62B for receiving the syphon coupler 18. The inlet 62 leads into a central bore 66 including a lower threaded portion 66T and an upper smooth wall portion 66S. The smooth wall portion 66S is in fluid communication with the ports 32 of the adaptor assembly 14.

Figure 6A:
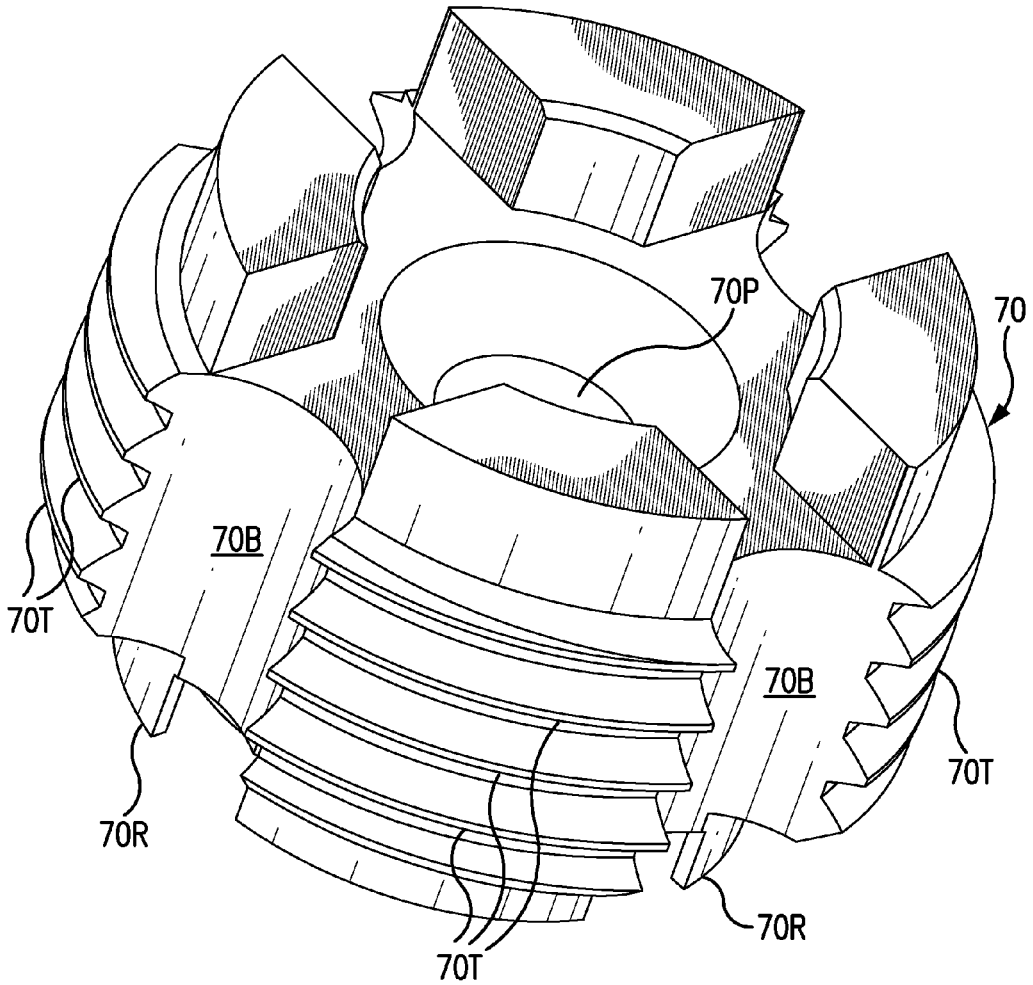
FIG. 6A is a top perspective view of the diaphragm holder.
Figure 6B:
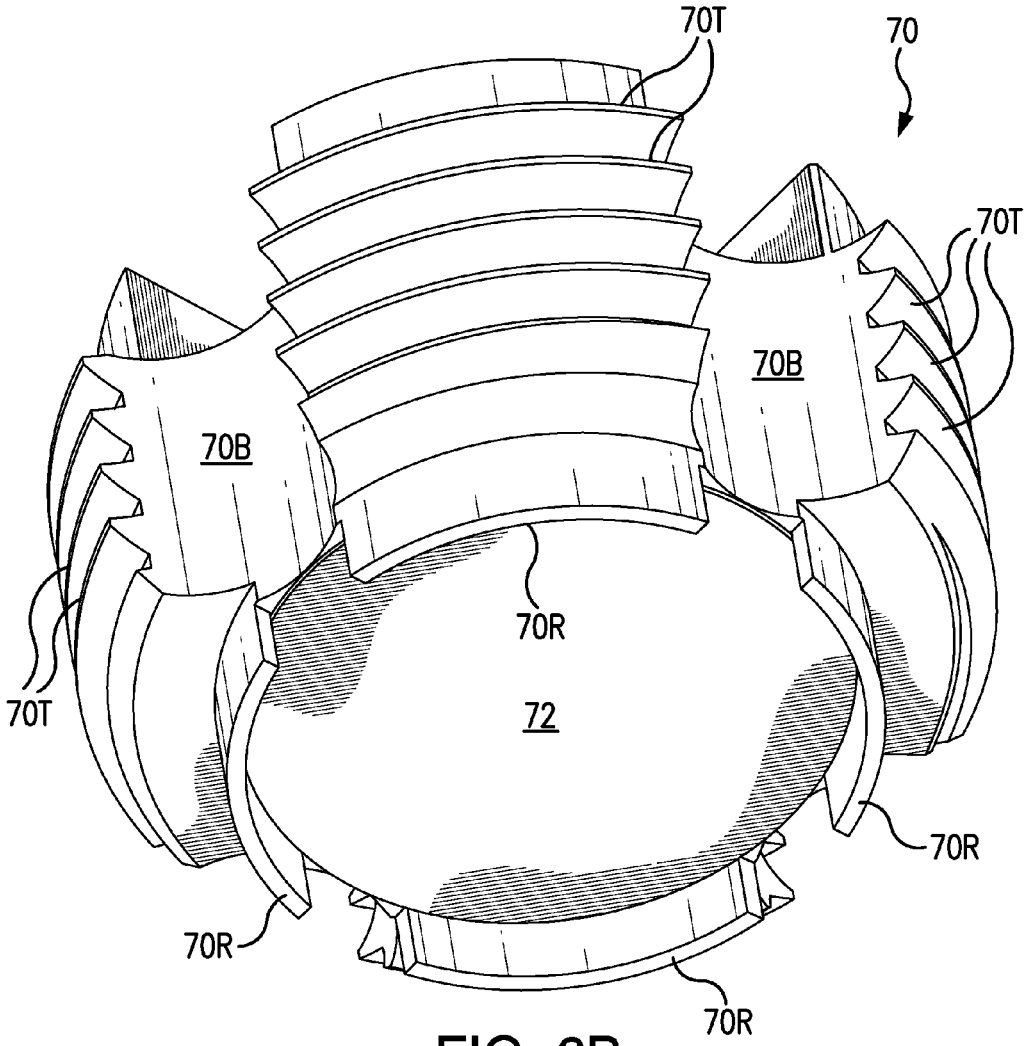
FIG. 6B is a bottom perspective view of FIG. 6A.
Figure 6C:
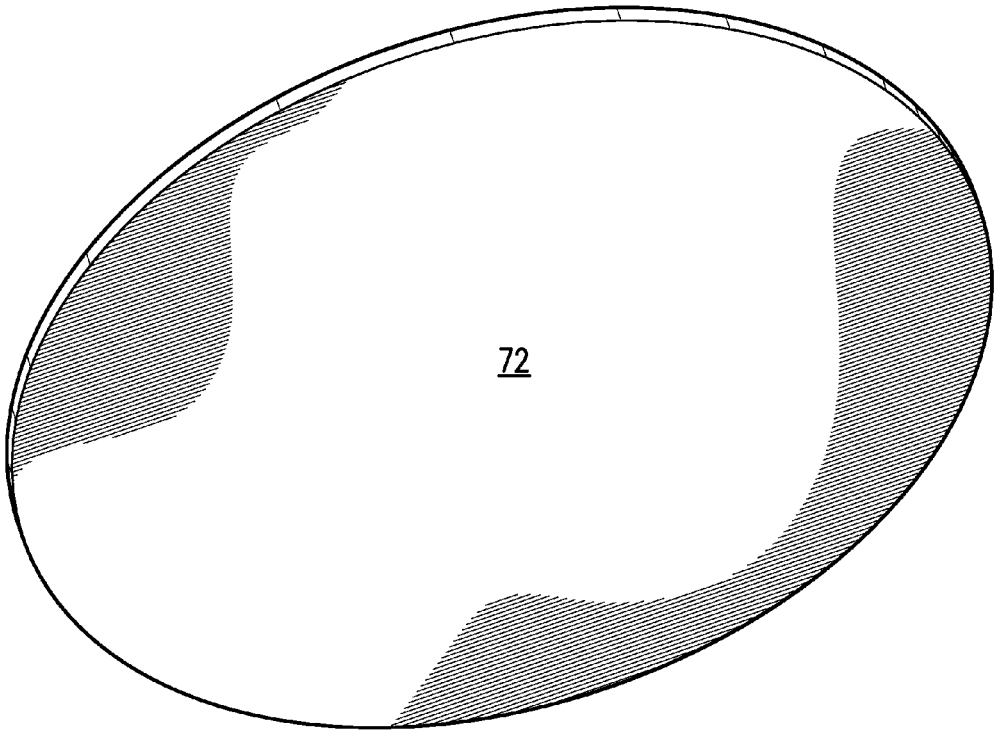
FIG. 6C is a perspective view of the diaphragm.

A diaphragm holder 70 is threadably positioned within the central bore 66. As shown in FIGS. 6A, 6B and 6C, the holder 70 includes an axial passageway 70P and external threads 70T. The inlet to the axial passageway 70P is sealed by means of a diaphragm 72 held into position by an annular rim 70R that is crimped over the annular peripheral edge of the diaphragm 72. When the diaphragm holder 70 is fully threaded into the central bore 66, the outer surface of the diaphragm 72 seals against the diaphragm seat 64. The diaphragm 72 is capable of being pierced by a pierce pin (described below) whereupon gas may flow from the gas cylinder through the axial passageway 70P. Bleed slots 70B are cut into the external threads 70T allowing the gas cylinder to be filled by backing off the diaphragm holder 70 to unseat the diaphragm 70.

Figure 7A:
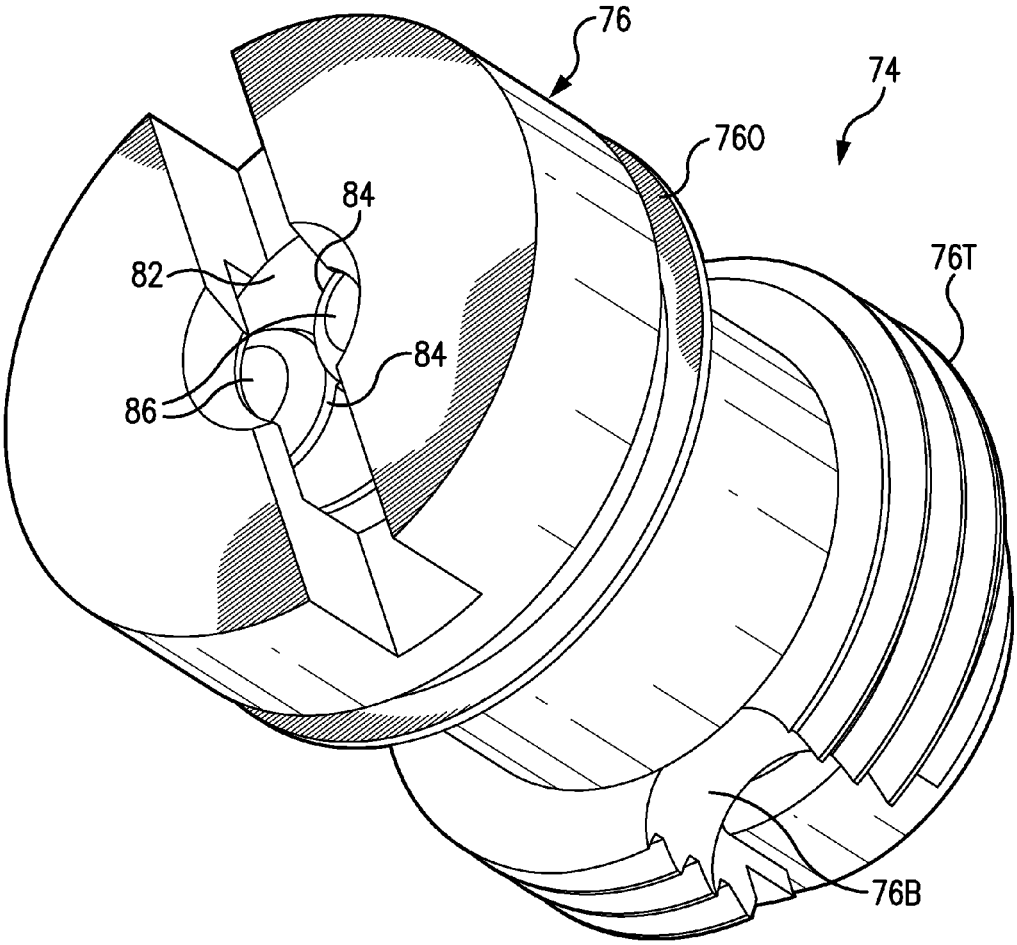
FIG. 7A is a top perspective view of a first embodiment of the firing assembly.
Figure 7B:
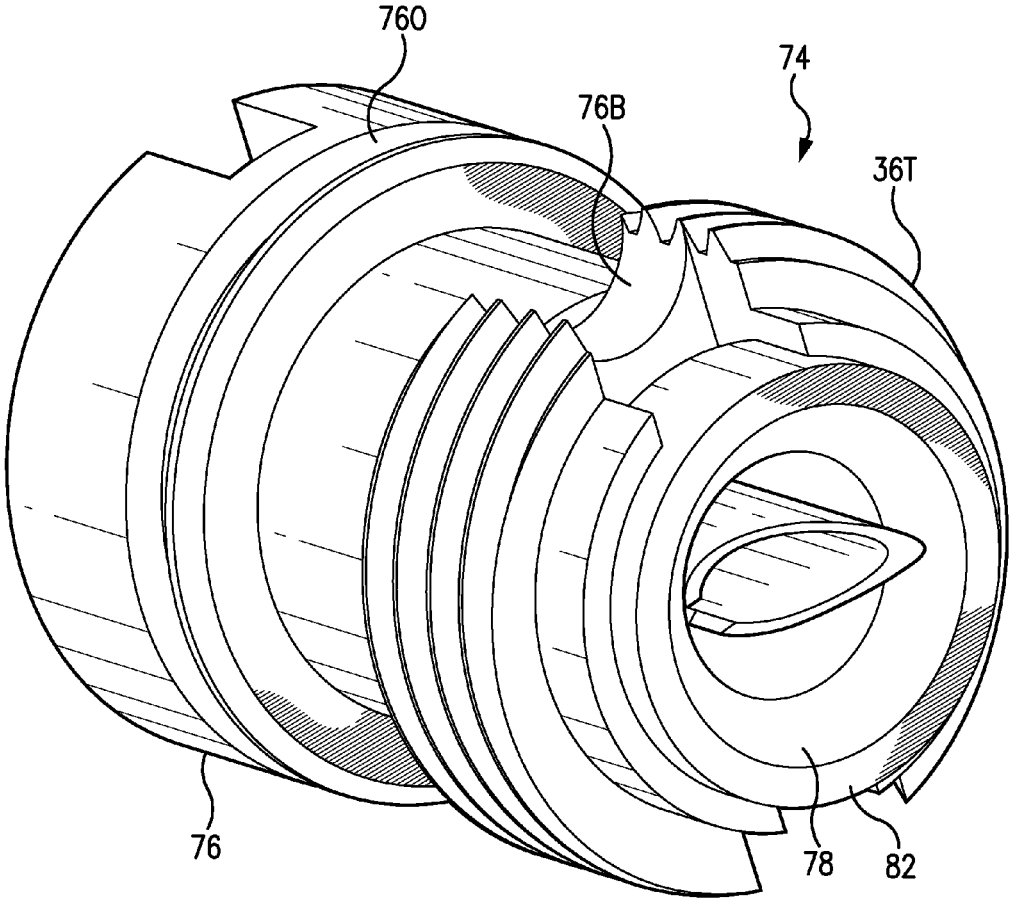
FIG. 7B is a bottom perspective view of FIG. 7A.

A firing assembly 74 is threadably positioned within the central bore 66. As shown in FIGS. 7A and 7B, the firing assembly 74 comprises a body 76 having lower external threads 76T for threadably engaging the threads 66T of the central bore 66. Bleed slots 76B allow gas from the gas cylinder to flow therefrom upon puncturing of the diaphragm 72, and then out the ports 32. An O-ring 76O prevents such gas from escaping out of the top of the adaptor assembly 14.

Figure 7C:
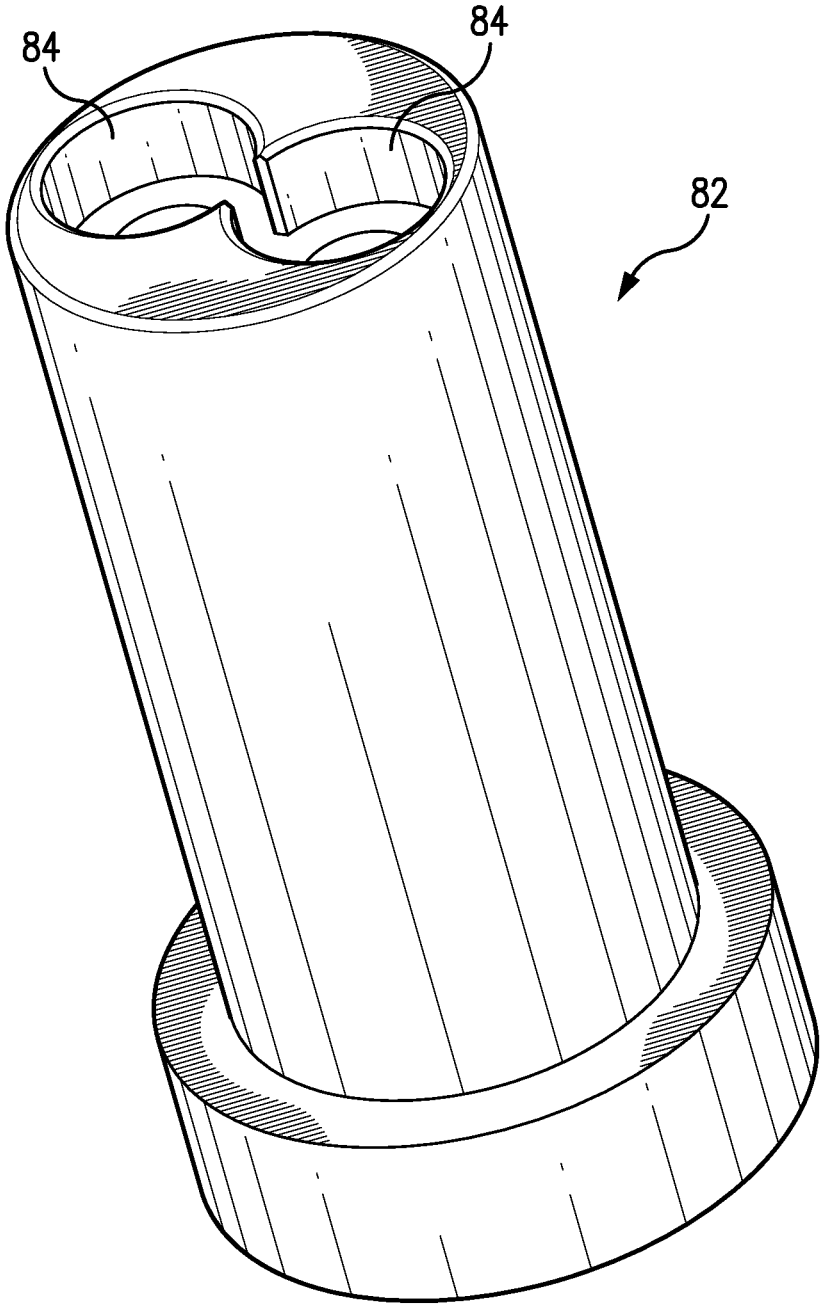
FIG. 7C is a top perspective view of the firing bushing.
Figure 7D:
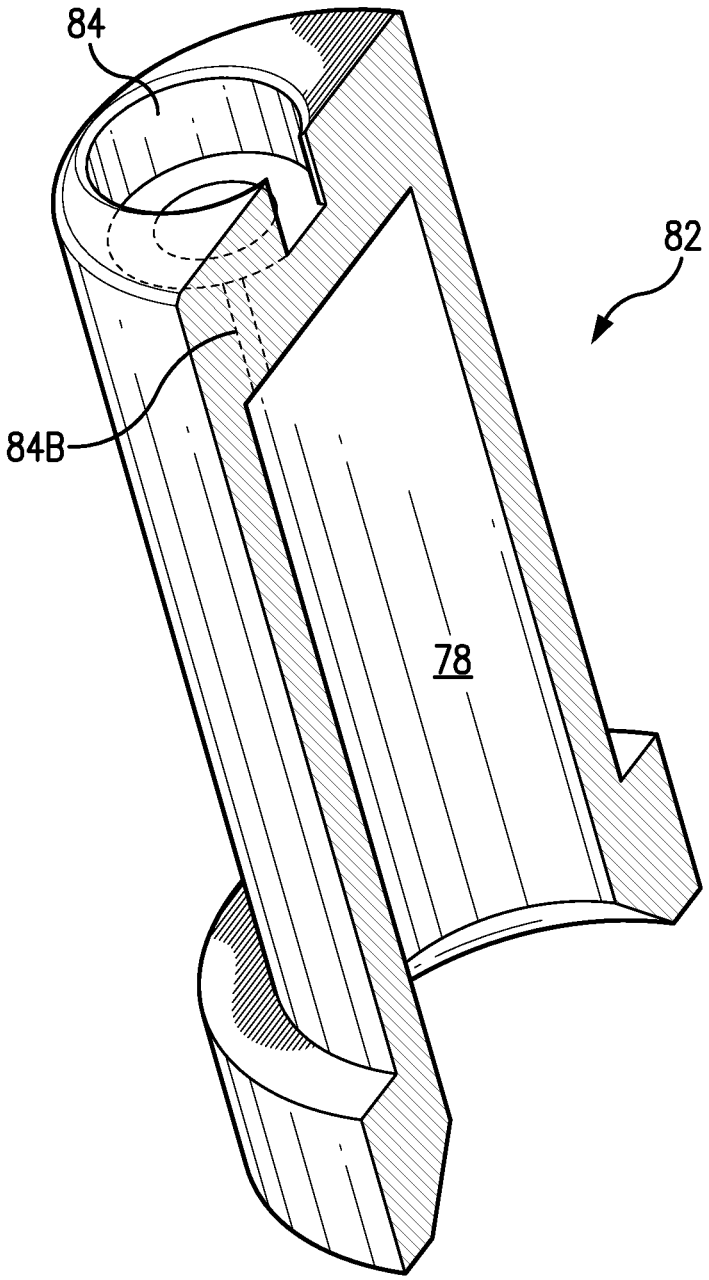
FIG. 7D is across-sectional view of FIG. 7C.
Figure 7E:
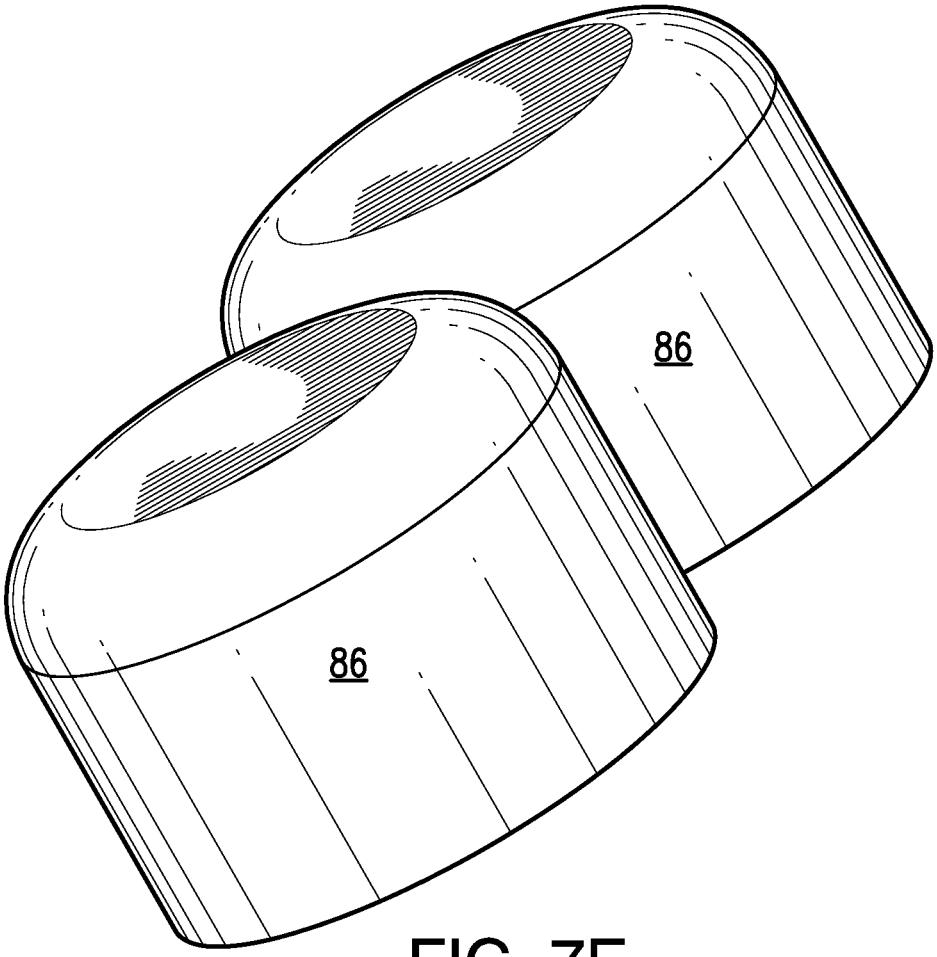
FIG. 7E is a top perspective view of the power primers.
Figure 7F:
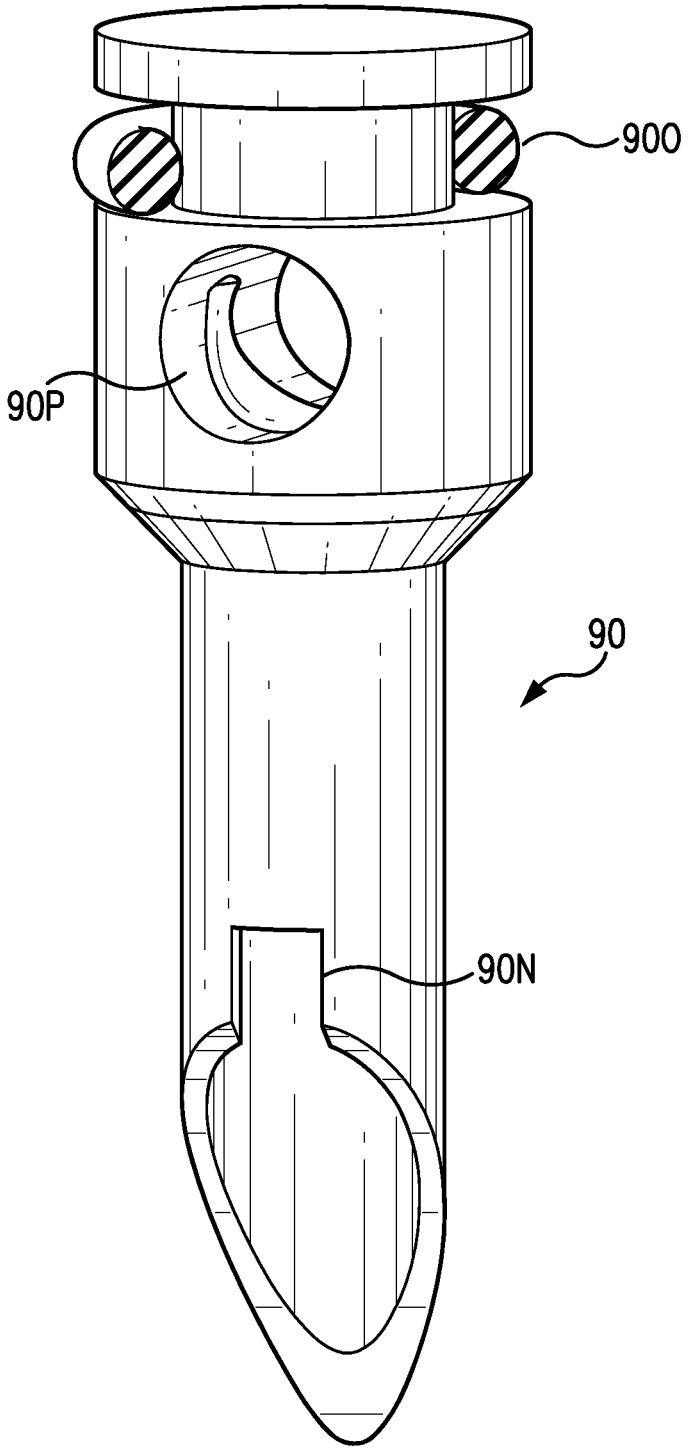
FIG. 7F is a top perspective view of firing pin.
Figure 7G:
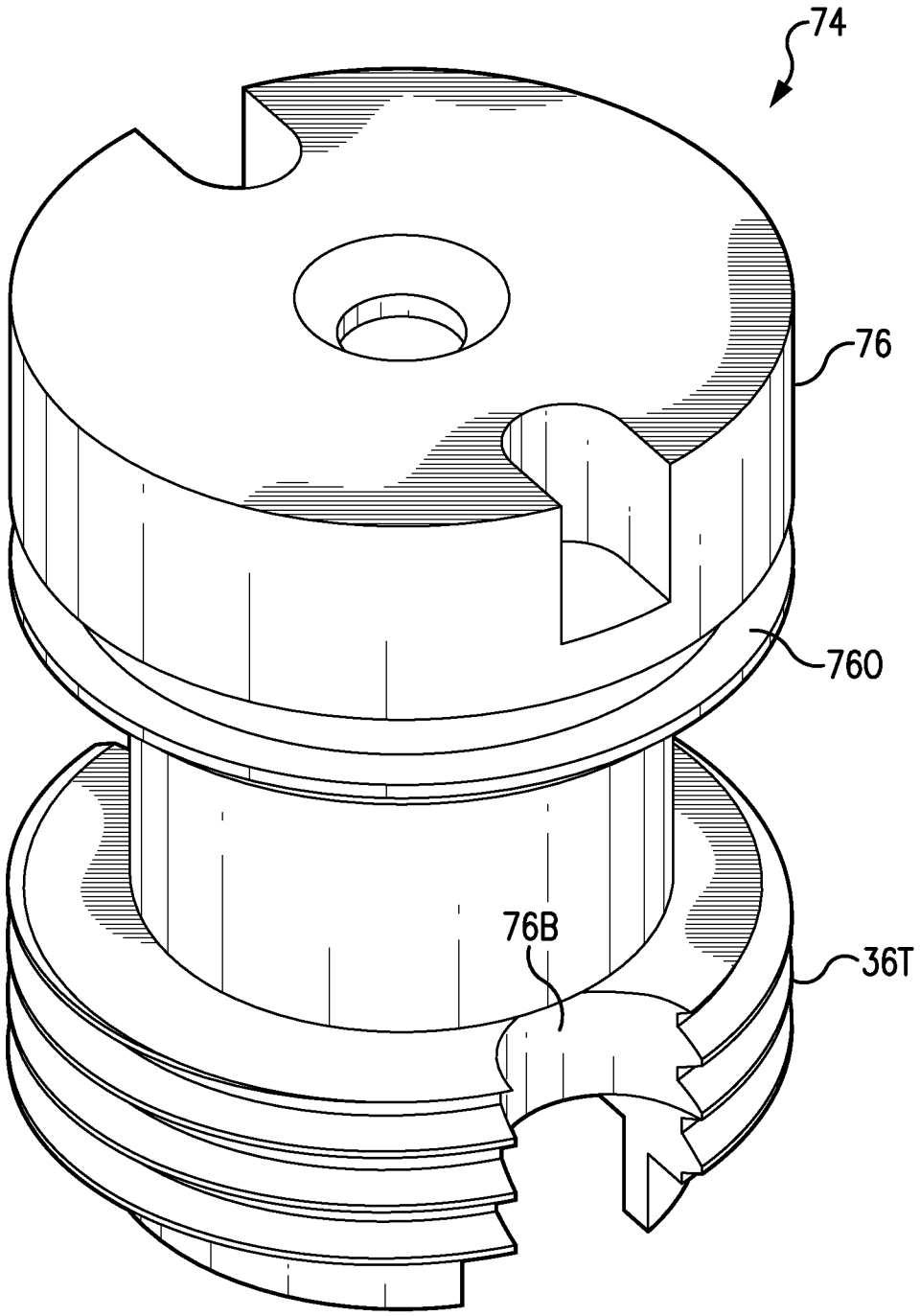
FIG. 7G is a top perspective view of the second embodiment of the firing assembly.
Figure 7H:
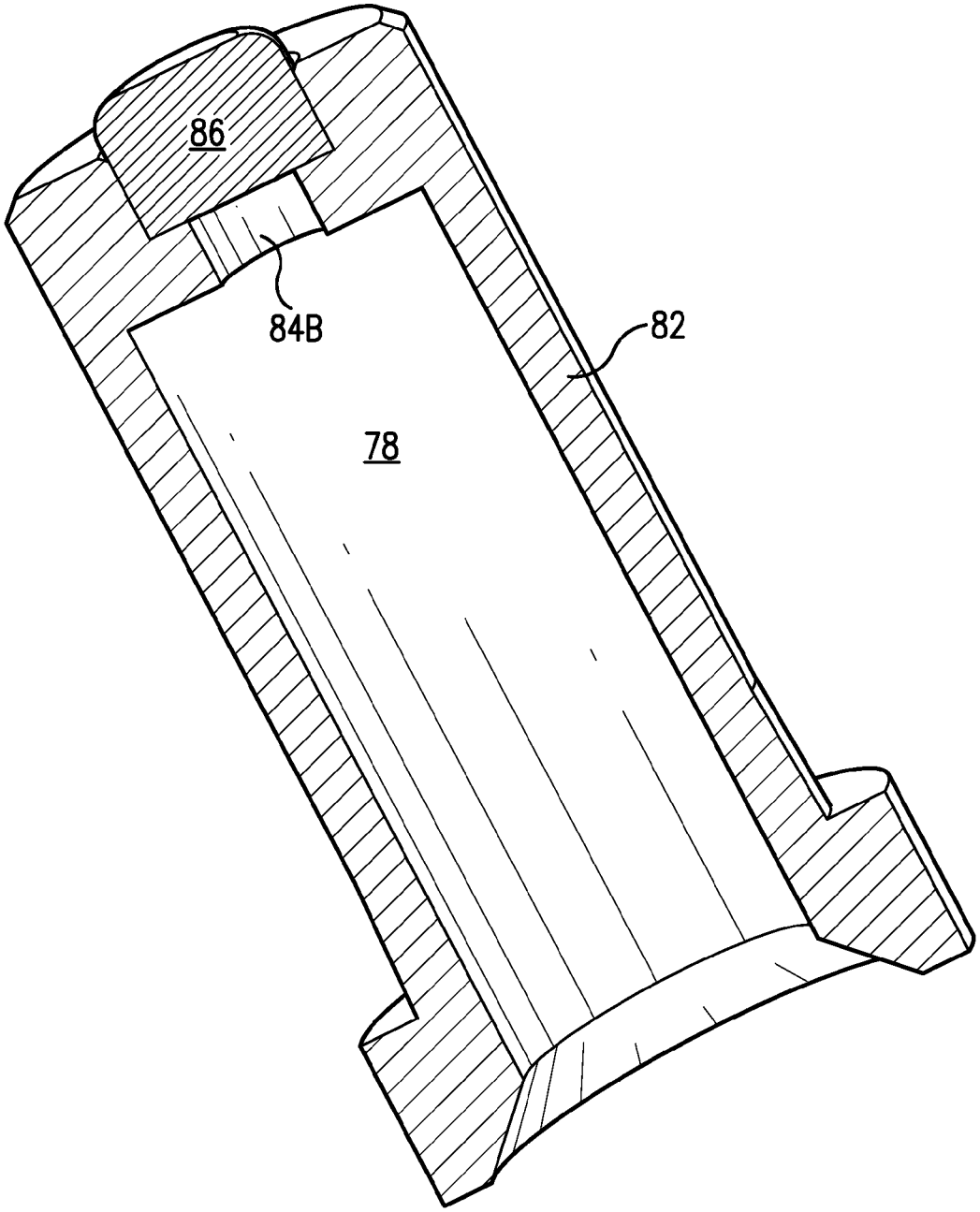
FIG. 7H is a cross-sectional view of FIG. 7G.

The firing assembly 74 further comprises a power primer assembly 80 positioned within a central bore 78 thereof. As shown in FIGS. 7C-7D, the power primer assembly 80 comprises a bushing 82 having two primer cavities 84 for receiving primers 86 (see FIG. 7E). Preferably primers 86 comprise the same type of primers used in center fire cartridges for firearms that when stuck with a firing pin, produce ignition gases when, in the case of firearm cartridges, then ignite the gunpowder in the cartridge to fire the bullet from the firearm. However, in the present invention, the pair of primers 86 are aligned with the rim 56R of the firing pin 56 such that when they are both struck by the rim 56R, they produce ignition gases. It is noted that two are preferred for double redundancy factor of always producing ignition gases upon being struck. However, as shown in FIGS. 7G and 7H, the power primer assembly 80 may be designed for using single primers 86 by having a single primer cavity 84 for a single primer 86 that is installed therein, which is then fired through the use of the actuator 52 with the bull-nosed single firing pin 57 shown in FIG. 4D. In both embodiments, the ignition gases from the primer(s) 86 flow through a bleed hole 84B extending from each of the primer cavities 84 to the central bore 78.

As shown in 7F, a pierce pin 90 is sealingly positioned with the central bore 78 of the power primer assembly 80 by means of an O-ring 90O. Upon firing of the primers 86, the ignition gases therefrom force the pierce pin 90 downwardly within central bore 78 to puncture the diaphragm 72. The pierce pin 90 is hollow to allow gas from the gas cylinder to flow therethrough and out side ports 90P and then exit the ports 32. A notch 90N in the beveled cutting tip of the pierce pin 90 forms a hinges in the diaphragm 72 as it is punctured, thereby assuring that the diaphragm 72 remains intact with the power primer assembly 80 and therefore does not fall inside the gas cylinder.

Figure 8:
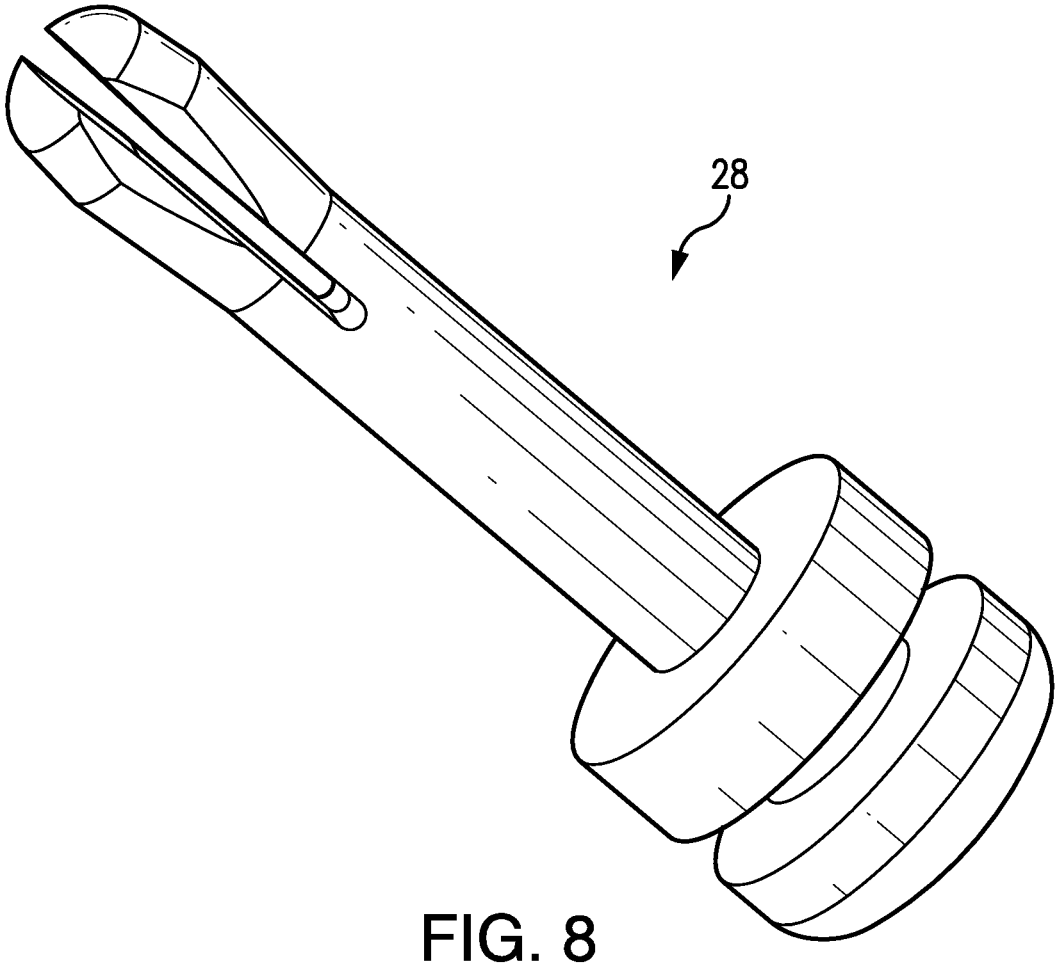
FIG. 8 is an enlarged perspective view of the safety pin.

FIG. 8 is an enlarged perspective view of the safety pin 28 that is inserted into the safety pin hole 30 for extra safety during shipping and setup of the raft inflator 10.

Figure 9:
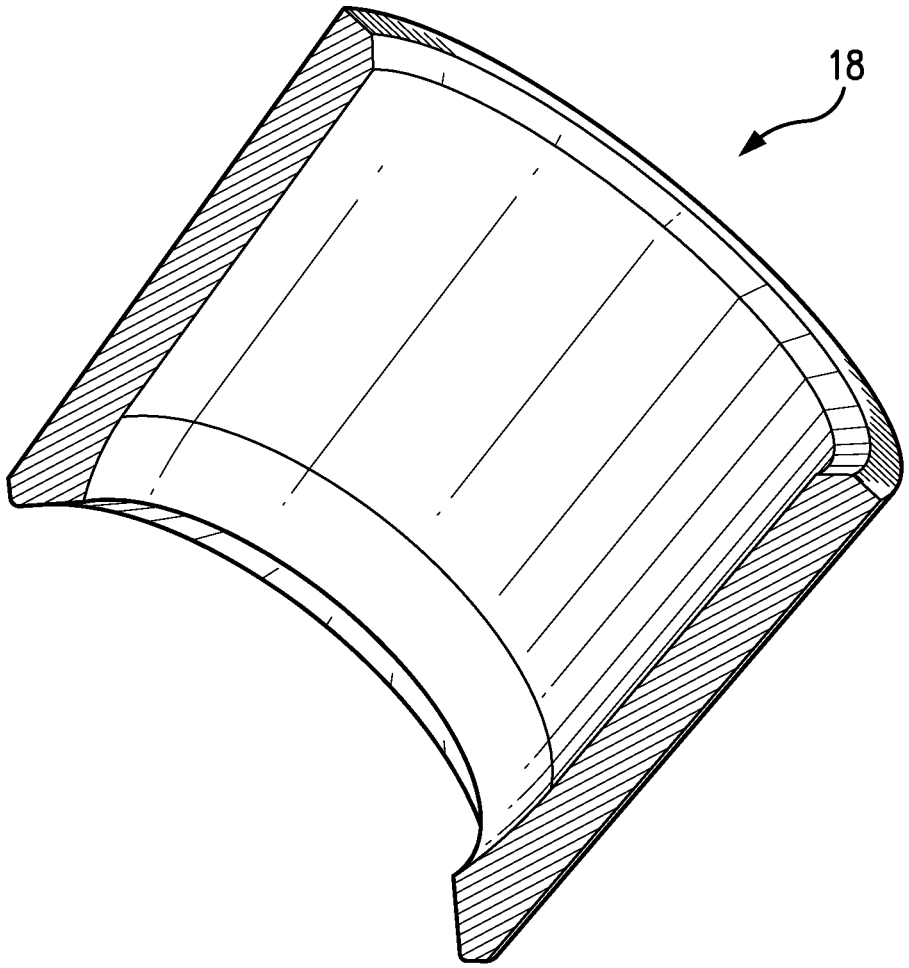
FIG. 9 is an enlarged sectional perspective view of the syphon coupler.

FIG. 9 is an enlarged sectional perspective view of the syphon coupler 18.

FIG. 10 is an enlarged sectional perspective view of the syphon weight 20.

FIG. 11 is a perspective view of the syphon tube 16 showing one end having a ball configuration 16B to fit into the socket of the syphon coupler 18 and the other end having a pair of opposing barbed tabs 16T that fit into the syphon weight 20. It is noted that the opposing barbed tabs 16T allow two tubes 16 to be connected end to end with the respective barbed tabs 16T of one tube 16 fitting into the other tube's opposing slots 16S, thereby doubling the effective length of the tube 16 for use with extra-long gas cylinders.

Second Embodiment

The second embodiment of the inflator 10 of the invention is shown in FIGS. 12-13A-C. The second embodiment differs from the first embodiment by having a universal adaptor assembly 100 in lieu of the two-port adaptor assembly 14 described above. The universal adaptor assembly 100 intended to be positioned within the inflatable device to be inflated. Upon pulling on the tether 24, the power module 12 functions as described above in connection with the first embodiment to pierce the frangible seal of a compressed gas cartridge (not shown) whereupon the escaping air therefrom exits the adaptor assembly 100 via an exhaust port 102 to inflate the inflatable device in which it is positioned.

More particularly, the power adaptor 12 is configured the same as described in connection with the first embodiment and therefore need not be described again. It is noted however, that the power adapter 12 of the second embodiment may be configured with a single or with double power primers 86 as may be desired for the particular inflatable device to be inflated.

The adaptor assembly 100 may be functionally configured the same as described in connection with the first embodiment but preferably includes the single exhaust port 102 to inflate the inflatable device in which it is positioned. Further, the need for the diaphragm holder 70 of the first embodiment is eliminated by incorporating a protruding step 104 into the bore 66 thereof (see FIGS. 13A-C). The lowermost end of the bushing 82 is seated onto the protruding step 104 instead of being seated onto the no-longer-needed diaphragm holder 70 of the first embodiment. Finally, the inlet 62 is threaded to threadably receive the threaded neck of a conventional compressed gas cartridge (not shown) having a frangible seal that is pierced by the pierce pin 90 upon firing.

The present invention includes that contained in the appended claims as well as that of the foregoing description. Although this description has been described in its preferred form with a certain degree of particularity, it should be understood that the present disclosure of the preferred form has been made only by way of example and that numerous changes in the details of construction, combination, or arrangement of parts thereof may be resorted to without departing from the spirit and scope of the invention.

Now that the invention has been described,

What is claimed is:

1. An inflator for inflating an inflatable device with gas from a gas cartridge, comprising in combination:

a power module assembly having an actuator pin reciprocatably mounted therein and an actuator spring for spring-loading said actuator pin that is held in a cocked, ready position until actuated;

a ballistic module containing at least one power primer that is fired by said actuator pin when actuated, said power primer producing gas to drive a pierce pin into engagement with a frangible seal to release the gas from the gas cartridge through an adaptor assembly into the inflatable device; and a syphon tube pivotably and fluidly connected to an output of said adaptor assembly allowing the tube, when the gas cylinder is oriented horizontally, to pivot downwardly toward the inside of the gas cylinder to draw liquid gas therefrom.

2. An inflator for inflating an inflatable device with gas from a gas cartridge, comprising in combination:

a power module assembly having an actuator pin reciprocatably mounted therein and an actuator spring for spring-loading said actuator pin that is held in a cocked, ready position until actuated;

a ballistic module containing at least one power primer that is fired by said actuator pin when actuated, said power primer producing gas to drive a pierce pin into engagement with a frangible seal to release the gas from the gas cartridge through an adaptor assembly into the inflatable device; and said adaptor assembly comprising two threaded ports allowing connection of conventional fill tubes fluidly connected to the inflatable device to be inflated, said ports being oriented in different directions to minimize undesirable torque being imparted to the inflator during inflation.

3. An inflator for inflating an inflatable device with gas from a gas cartridge, comprising in combination:

a power module assembly having an actuator pin reciprocatably mounted therein and an actuator spring for spring-loading said actuator pin that is held in a cocked, ready position until actuated;

a ballistic module containing at least one power primer that is fired by said actuator pin when actuated, said power primer producing gas to drive a pierce pin into engagement with a frangible seal to release the gas from the gas cartridge through an adaptor assembly into the inflatable device;

said adaptor assembly comprising a diaphragm holder threadably positioned within a central bore and wherein said frangible seal comprises a diaphragm that seals the gas cartridge until being fractured by said pierce pin, said diaphragm being mounted to said diaphragm holder; and said diaphragm being mounted to said diaphragm holder by an annular rim that is crimped over the annular peripheral edge of the diaphragm and wherein said diaphragm comprises a threaded connection with a bore of said adaptor assembly to seal against a diaphragm seat formed in said bore of the adaptor assembly.

4. The inflator as set forth in claim 3, wherein said diaphragm holder comprises at least one bleed slot allowing the gas cylinder to be filled by unthreading the diaphragm holder to unseat the diaphragm from said diaphragm seat.

5. An inflator for inflating an inflatable device with gas from a gas cartridge, comprising in combination:

a power module assembly having an actuator pin reciprocatably mounted therein and an actuator spring for spring-loading said actuator pin that is held in a cocked, ready position until actuated;

a ballistic module containing at least one power primer that is fired by said actuator pin when actuated, said power primer producing gas to drive a pierce pin into engagement with a frangible seal to release the gas from the gas cartridge through an adaptor assembly into the inflatable device;

said adaptor assembly comprising a diaphragm holder threadably positioned within a central bore and wherein said frangible seal comprises a diaphragm that seals the gas cartridge until being fractured by said pierce pin, said diaphragm being mounted to said diaphragm holder; and said ballistic module comprising a firing assembly threadably positioned within a bore of said adaptor assembly; and said firing assembly further comprising a power primer assembly positioned within a central bore, said power primer assembly comprising a bushing having at least one primer cavity for receiving said power primer and a bleed hole extending from said primer cavity to said central bore.

6. The inflator as set forth in claim 5, wherein said pierce pin is sealingly and reciprocally positioned with said central bore such that upon firing of said primer, the gases therefrom force said pierce pin downwardly within said central bore to puncture said frangible seal.

7. The inflator as set forth in claim 6, wherein said pierce pin is hollow to allow gas from the gas cylinder to flow therethrough and wherein said a notch is formed in a beveled cutting tip of said pierce pin to form a hinge in said frangible seal as it is punctured, thereby assuring that the frangible seal remains intact with said power primer assembly.

8. The inflator as set forth in claim 5, wherein said bore comprises a protruding step and wherein a lowermost end of said bushing is seated onto the protruding step.

* * * * *